US007405354B2

(12) United States Patent
Usa

(10) Patent No.: US 7,405,354 B2
(45) Date of Patent: Jul. 29, 2008

(54) MUSIC ENSEMBLE SYSTEM, CONTROLLER USED THEREFOR, AND PROGRAM

(75) Inventor: Satoshi Usa, Hamamatsu (JP)

(73) Assignee: Yamaha Corporation, Shizuoka-Ken (JP)

( * ) Notice: Subject to any disclaimer, the term of this patent is extended or adjusted under 35 U.S.C. 154(b) by 0 days.

(21) Appl. No.: 11/686,369

(22) Filed: Mar. 15, 2007

(65) Prior Publication Data

US 2007/0214942 A1 Sep. 20, 2007

(30) Foreign Application Priority Data

Mar. 15, 2006 (JP) ..... 2006-071255
Mar. 15, 2006 (JP) ..... 2006-071256

(51) Int. Cl.
*G10H 1/36* (2006.01)
*G10H 7/00* (2006.01)

(52) U.S. Cl. ..... 84/610; 84/600; 84/601; 84/615; 84/634

(58) Field of Classification Search ..... None
See application file for complete search history.

(56) References Cited

U.S. PATENT DOCUMENTS

| | | | | |
|---|---|---|---|---|
| 7,164,075 | B2 * | 1/2007 | Tada | 84/610 |
| 2003/0167904 | A1 * | 9/2003 | Itoh | 84/609 |
| 2003/0167906 | A1 * | 9/2003 | Isozaki | 84/615 |
| 2005/0120865 | A1 * | 6/2005 | Tada | 84/600 |
| 2006/0185502 | A1 * | 8/2006 | Nishitani et al. | 84/615 |
| 2007/0214943 | A1 * | 9/2007 | Usa | 84/609 |
| 2007/0214946 | A1 * | 9/2007 | Usa | 84/645 |

FOREIGN PATENT DOCUMENTS

JP 2000-276136 10/2000

* cited by examiner

*Primary Examiner*—Marlon T Fletcher
(74) *Attorney, Agent, or Firm*—Harness, Dickey & Pierce, PLC

(57) ABSTRACT

A music ensemble system that enables changing the assignment of playing parts to performance terminals with a simpler operation. The music ensemble system comprising a plurality of performance terminals and a controller capable of communicating with the performance terminals to control playing of the performance terminals. Each of the performance terminals comprises a playing operation unit adapted to receive a player's playing operation and generates operation information, a terminal communication unit adapted to communicate with the controller to transmit the operation information to the controller, and a tone generator adapted to produce musical sounds based on sound instruction data received by the terminal communication unit. The controller comprises a controller communication unit adapted to communicate with each of the performance terminals, a music data storage unit adapted to contain music data including a plurality of playing parts, a playing control unit adapted to, upon reception of the operation information by the controller communication unit from the performance terminal, read out a playing part assigned to the performance terminal from the music data storage unit based on part assignment information indicating the assignment of the playing parts to the performance terminals, and transmit sound instruction data for sounding the playing part to the performance terminal via the controller communication unit, an operation unit having a part change operator, and a playing part changing unit adapted to modify the part assignment information according to a predetermined change pattern upon operating of the part change operator.

13 Claims, 15 Drawing Sheets

FIG. 4A

ACCOMPANIMENT 1 PART
CH1: 10 SOUNDS
RHYTHM PART
CH6: 1000 SOUNDS
MELODY PART
CH5: 2000 SOUNDS

F

1

5

ACCOMPANIMENT 2 PART
CH2: 20 SOUNDS

2

4

ACCOMPANIMENT 3 PART
CH3: 100 SOUNDS
ACCOMPANIMENT 4 PART
CH4: 200 SOUNDS

3

FIG. 4B

ACCOMPANIMENT 1 PART
CH1: 10 SOUNDS
MELODY PART
CH5: 2000 SOUNDS

F

1

5

2

4

ACCOMPANIMENT 2 PART
CH2: 20 SOUNDS
RHYTHM PART
CH6: 1000 SOUNDS

ACCOMPANIMENT 3 PART
CH3: 100 SOUNDS
ACCOMPANIMENT 4 PART
CH4: 200 SOUNDS

3

FIG. 10

MUSIC DATA (FOR ONE PIECE OF MUSIC)

| |
|---|
| PART ID 1<br>(PART IDENTIFICATION INFORMATION) |
| MUSIC DATA (PLAYING INFORMATION) |
| PART ID 2<br>(PART IDENTIFICATION INFORMATION) |
| MUSIC DATA (PLAYING INFORMATION) |
| ⋮ |

FIG. 14

PART ASSIGNMENT TABLE

| TERMINAL ID | PLAYING PART |
|---|---|
| 0 | F (FACILITATOR) |
| 1 | ACCOMPANIMENT 1 PART |
| 2 | ACCOMPANIMENT 2 PART |
| 3 | RHYTHM PART |
| 4 | ACCOMPANIMENT 3 PART |
| 5 | MELODY PART |

MUSIC ENSEMBLE SYSTEM, CONTROLLER USED THEREFOR, AND PROGRAM

BACKGROUND OF THE INVENTION

1. Field of the Invention

The present invention relates to a music ensemble system, a controller used therefor, and a program that enable users to operate a plurality of performance terminals and readily play music together by setting respective performance terminals to support playing of different playing parts. More particularly, the present invention relates to an improvement in changing the assignment of playing parts to the performance terminals.

2. Description of the Related Art

Concerted music playing systems are known that enable users to operate a plurality of performance terminals and readily play music together by setting respective performance terminals to support playing of different playing parts. Some of these music ensemble systems change the assignment of playing parts to the performance terminals. Playing parts as used herein refer to parts such as melodies and rhythm sounds that constitute a piece of music ensemble. Playing parts may include, by way of example, melody parts, rhythm parts, accompaniment parts of different tones (e.g., tones of different instruments), and so on.

For example, Japanese Patent Laid-Open No. 2000-276136 describes a music playing system including a plurality of slave devices and one master device. The master device is provided with as many connectors as the slave devices, and the respective connecters correspond to different playing parts. Once the respective slave devices are connected to the connectors, sound data about a piece of music for a playing part corresponding to each of the connectors is input to the slave device from the master device. A player of the slave device vibrates the slave device to cause it to produce musical sounds based on the input sound data. Thus, the respective users can play different particular part to play music together by vibrating the user's slave devices in a timed manner.

When the same music ensemble is played together for a number of times, each of the players may desire to play a playing part different from one played the last time. In such a case, it may not be important which playing part is assigned to which performance terminal, but changing the assigned playing parts in any manner may suffice. The music playing system of the Japanese Patent Laid-Open No. 2000-276136 does not provide high operability in this situation. It requires reconnecting each of the performance terminals (slave devices) to connectors corresponding to a desired tone every time the parts are changed, because each of the connectors corresponds to a certain part.

In addition, the Japanese Patent Laid-Open No. 2000-276136 only discloses a case where the playing parts are assigned to the slave devices (performance terminals) in a one-to-one relationship, but not a case where music is played with a larger number of playing parts than the number of performance terminals. If music is played with a larger number of playing parts than the number of performance terminals, the differences in the number of sounds (the number of sound data items such as Note On data items) of the playing parts may cause a significant imbalance in the total number of sounds of the playing parts assigned to the respective performance terminals, depending on the manner of assigning the playing parts.

For example, suppose that there are playing parts with 2000 sounds, 1000 sounds, 100 sounds, and 20 sounds, respectively. The playing part with 2000 sounds and the playing part with 1000 sounds are assigned to one performance terminal, and the playing part with 100 sounds and the playing part with 20 sounds are assigned to another terminal. Then, the number of sounds of the playing parts assigned to the two terminals is 3000 and 120 respectively, resulting in a significant imbalance.

SUMMARY OF THE INVENTION

To solve the above problems, the present invention provides a music ensemble system, a controller used therefor, and a program that enable changing the assignment of playing parts to performance terminals with a simpler operation.

To solve the above problems, the present invention provides a music ensemble system, a controller used therefor, and a program that enable assigning playing parts to performance terminals so that the number of sounds for each of the performance terminals approximates that for the other performance terminals.

In a first aspect of the present invention, there is provided a music ensemble system comprising a plurality of performance terminals and a controller capable of communicating with the performance terminals to control playing of the performance terminals, each of the performance terminals comprising: a playing operation unit adapted to receive a player's playing operation and generate operation information; a terminal communication unit adapted to communicate with the controller to transmit the operation information to the controller; and a tone generator adapted to produce musical sounds based on sound instruction data received by the terminal communication unit, and the controller comprising: a controller communication unit adapted to communicate with each of the performance terminals; a music data storage unit adapted to contain music data including a plurality of playing parts; a playing control unit adapted to, upon reception of the operation information by the controller communication unit from the performance terminal, read out a playing part assigned to the performance terminal from the music data storage unit based on part assignment information indicating the assignment of the playing parts to the performance terminals, and transmit sound instruction data for sounding the playing part to the performance terminal via the controller communication unit; an operation unit having a part change operator; and a playing part changing unit adapted to modify the part assignment information according to a predetermined change pattern upon operating of the part change operator.

In a second aspect of the present invention, there is provided a controller capable of communicating with a plurality of performance terminals to control playing of the performance terminals, each of the performance terminals having a function of receiving a player's playing operation, generating operation information, and transmitting the operation information to the controller, and a function of producing musical sounds based on sound instruction data, the controller comprising: a communication unit adapted to communicate with each of the performance terminals; a music data storage unit adapted to contain music data including a plurality of playing parts; a playing control unit adapted to, upon reception of the operation information by the communication unit from the performance terminal, read out a playing part assigned to the performance terminal from the music data storage unit based on part assignment information indicating the assignment of the playing parts to the performance terminals, and transmit sound instruction data for sounding the playing part to the performance terminal via the communication unit; an operation unit having a part change operator; and a playing part changing unit adapted to modify the part assignment information according to a predetermined change pattern upon operating of the part change operator.

The playing control unit can store, as the part assignment information, information associating IDs indicating the order of the performance terminals with corresponding playing parts, and the playing part changing unit can modify the part assignment information by shifting the correspondence between the playing parts and the IDs by a predetermined number in the order indicated by the IDs or in the reverse order thereof.

The playing control unit can store, as the part assignment information, information associating IDs of the performance terminals with corresponding playing parts, and the playing part changing unit can modify the part assignment information by randomly changing the correspondence between the playing parts and the IDs.

In a third aspect of the present invention, there is provided a program for causing a controller of controlling playing of a plurality of performance terminals to execute: a receiving process of receiving operation information generating, upon reception of a player's playing operation, by the performance terminal; a playing control process of, upon reception of the operation information in the receiving process, reading out a playing part assigned to the performance terminal based on part assignment information indicating the assignment of the playing parts to the performance terminals, among music data including playing parts, each of the playing parts including a plurality of sound data items, transmitting sound data items of the playing part to the performance terminal via the controller communication unit, and causing the performance terminal to produce musical sounds based on sound data; and a playing part change process of, upon reception of a changing operation of changing the playing part, modifying the part assignment information according to a predetermined change pattern.

In a fourth aspect of the present invention, there is provided a music ensemble system comprising a plurality of performance terminals and a controller capable of communicating with the performance terminals to control playing of the performance terminals, each of the performance terminals comprising: a playing operation unit adapted to receive a player's playing operation and generate operation information; a terminal communication unit adapted to communicate with the controller to transmit the operation information to the controller; and a tone generator adapted to produce musical sounds based on sound data items received by the terminal communication unit, and the controller comprising: a controller communication unit adapted to communicate with each of the performance terminals; a music data storage unit adapted to contain music data including a plurality of playing parts, each of the playing parts including a plurality of sound data items; a playing control unit adapted to, upon reception of the operation information by the controller communication unit from the performance terminal, read out a playing part assigned to the performance terminal from the music data storage unit based on part assignment information indicating the assignment of the playing parts to the performance terminals, and transmit sound data items of the playing part to the performance terminal via the controller communication unit; an operation unit including a playing part changing control adapted to receive a changing operation of changing the playing part; and a playing part assignment unit adapted to, upon reception of the changing operation by the operation unit, compute the number of sound data items of each playing part and set the playing part assignment information in the playing control unit based on the computed number so that sound data items assigned to the performance terminals approximate one another in number.

In a fifth aspect of the present invention, there is provided a music ensemble system comprising a plurality of performance terminals and a controller capable of communicating with the performance terminals to control playing of the performance terminals, each of the performance terminals comprising: a playing operation unit adapted to receive a player's playing operation and generate operation information; a terminal communication unit adapted to communicate with the controller to transmit the operation information to the controller; and a tone generator adapted to produce musical sounds based on sound data items received by the terminal communication unit, and the controller comprising: a controller communication unit adapted to communicate with each of the performance terminals; a music data storage unit adapted to contain music data including a plurality of playing parts, each of the playing parts including a plurality of sound data items; a playing control unit adapted to, upon reception of the operation information by the controller communication unit from the performance terminal, read out a playing part assigned to the performance terminal from the music data storage unit based on part assignment information indicating the assignment of the playing parts to the performance terminals, and transmit sound data items of the playing part to the performance terminal via the controller communication unit; an operation unit including a readout operator adapted to receive a readout operation of reading out the music data; and a playing part assignment unit adapted to, upon reception of the readout operation by the operation unit, compute the number of sound data items of each playing part and set the playing part assignment information in the playing control unit based on the computed number so that sound data items assigned to the performance terminals approximate one another in number.

In a sixth aspect of the present invention, there is provided a controller connected with a plurality of performance terminals to control playing of the performance terminals, each of the performance terminals having a function of receiving a player's playing operation, generate operation information, and a function of producing musical sounds based on sound data, the controller comprising: a controller communication unit adapted to communicate with each of the performance terminals; a music data storage unit adapted to contain music data including a plurality of playing parts, each of the playing parts including a plurality of sound data items; a playing control unit adapted to receive the operation information generated by the performance terminal via the controller communication unit, read out a playing part assigned to the performance terminal from the music data storage unit based on part assignment information indicating the assignment of the playing parts to the performance terminals, and transmit sound data items of the playing part to the performance terminal via the controller communication unit; an operation unit including a playing part changing control adapted to receive a changing operation of changing the playing part; and a playing part assignment unit adapted to, upon reception of the changing operation by the operation unit, compute the number of sound data items of each playing part and set the playing part assignment information in the playing control unit based on the computed number so that the number of sound data items assigned to each of the performance terminals approximates the number of sound data items assigned to the other performance terminals.

When the number of the playing parts is not less than twice the number of the performance terminals to which the playing parts are to be assigned, the playing part assignment unit can set the playing part assignment information in the playing control unit so that playing parts in decreasing order of the number of sounds are paired with playing parts in increasing order of the number of sounds respectively and assigned to each of the performance terminals.

In a seventh aspect of the present invention, there is provided a controller connected with a plurality of performance terminals to control playing of the performance terminals, each of the performance terminals having a function of receiving a player's playing operation to generate operation information, and a function of producing musical sounds based on sound data, the controller comprising: a controller communication unit adapted to communicate with each of the performance terminals; a music data storage unit adapted to contain music data including a plurality of playing parts, each of the playing parts including a plurality of sound data items; a playing control unit adapted to receive the operation information generated by the performance terminal via the controller communication unit, read out a playing part assigned to the performance terminal from the music data storage unit based on part assignment information indicating the assignment of the playing parts to the performance terminals, and transmit sound data items of the playing part to the performance terminal via the controller communication unit; an operation unit including a readout operator adapted to receive a readout operation of reading out the music data; and a playing part assignment unit adapted to, upon reception of the readout operation by the operation unit, compute the number of sound data items of each playing part and set the playing part assignment information in the playing control unit based on the computed number so that sound data items assigned to the performance terminals approximate one another in number.

When the number of the playing parts is not less than twice the number of the performance terminals to which the playing parts are to be assigned, the playing part assignment unit can set the playing part assignment information in the playing control unit so that playing parts in decreasing order of the number of sounds are paired with playing parts in increasing order of the number of sounds respectively and assigned to each of the performance terminals.

In a eighth aspect of the present invention, there is provided a program for causing a controller of controlling playing of a plurality of performance terminals to execute: a receiving process of receiving operation information generating, upon reception of a player's playing operation, by the performance terminal; a playing control process of, upon reception of the operation information in the receiving process, reading out a playing part assigned to the performance terminal based on part assignment information indicating the assignment of the playing parts to the performance terminals, among music data including playing parts, each of the playing parts including a plurality of sound data items, transmitting sound data items of the playing part to the performance terminal via the controller communication unit, and causing the performance terminal to produce musical sounds based on sound data; and a playing part assignment of, upon reception of a changing operation of changing the playing part, computing the number of sound data items of each of the playing parts and setting the playing part assignment information in the playing control unit based on the computed number so that sound data items assigned to the performance terminals approximate one another in number.

In a ninth aspect of the present invention, there is provided a program for causing a controller of controlling playing of a plurality of performance terminals to execute: a receiving process of receiving operation information generating, upon reception of a player's playing operation, by the performance terminal; a playing control process of, upon reception of the operation information in the receiving process, reading out a playing part assigned to the performance terminal based on part assignment information indicating the assignment of the playing parts to the performance terminals, among music data including playing parts, each of the playing parts including a plurality of sound data items, transmitting sound data items of the playing part to the performance terminal via the controller communication unit, and causing the performance terminal to produce musical sounds based on sound data; and a playing part assignment of, upon reception of a read out operation of reading out the music data, computing the number of sound data items of each of the playing parts and setting the playing part assignment information in the playing control unit based on the computed number so that sound data items assigned to the performance terminals approximate one another in number.

According to the first to third aspects of the present invention, when the playing operation unit receives a player's playing operation, operation information is input from the performance terminal to the controller (the controller communication unit). In the controller, the playing control unit reads out a playing part based on the input operation information. Here, the playing part is read out according to part assignment settings. Therefore, the playing control unit reads out the playing part conforming to the part assignment information, and sound instruction data for this playing part is transmitted to the performance terminal via the controller communication unit. Thus, each of the performance terminals plays music with the playing part conforming to the part assignment settings, thereby playing music ensemble as a whole.

When a piece of music is played together for a number of times, it may be desired to change the playing parts assigned to the performance terminals to prevent the players from being bored with playing. In this case, what is important is often not which playing part is assigned to which performance terminal, but that the playing part assigned to each of the performance terminals is changed in any way.

According to the first to third aspects of the present invention, when a part change operator is operated, the playing part changing unit modifies the part assignment information in the playing control unit according to a predetermined pattern. With a simple operation of only operating the part change operator by a user (a player or a facilitator), the assignment of the playing parts to the performance terminals is modified according to the predetermined change pattern. Thus, the playing part assigned to each of the performance terminals can be changed only with a simple operation, and the players can play music with a playing part different from one assigned in the last playing.

According to the first to third aspects of the present invention, the part assignment information is information that associates IDs indicating the order of the performance terminals with corresponding playing parts. The playing part changing unit modifies the part assignment information by shifting the correspondence between the playing parts and the IDs by a predetermined number in the order indicated by the IDs or in the reverse order thereof. With a simple operation of only operating the part change operator by a user (a player or the facilitator), the correspondence between the playing parts and the IDs can be shifted by a predetermined number in the order indicated by the IDs or in the reverse order thereof. Thus, every time the change operator is operated, each of the performance terminals can be assigned a different playing part until the first playing part comes full circle and is assigned again to its original performance terminal.

According to the first to third aspects of the present invention, the part assignment information is information that associates IDs of the performance terminals with corresponding playing parts. With a simple operation of only operating the part change operator by a user (a player or the facilitator), the playing part changing unit modifies the part assignment information by randomly changing the correspondence between the playing parts and the IDs. Thus, every time the change operator is operated, the playing parts can be assigned to the performance terminals in such a manner that the players cannot predict which playing part will be assigned.

According to the present invention, with a simple operation of only operating the part change operator by a user (a player or the facilitator), the assignment of the playing parts to the performance terminals is changed according to the predetermined change pattern. Therefore, the playing part assigned to each of the performance terminals can be changed only with a simple operation, and the players can play music with a playing part different from one assigned in the last playing. This allows the players to participate in playing the music ensemble without being bored and enjoy playing together.

According to the fourth to ninth aspects of the present invention, when the playing operation unit receives a player's playing operation, an operation signal is input from the performance terminal to the controller (the communication unit). In the controller, the playing control unit reads out a playing part based on the input operation signal. Here, the playing part is read out according to playing part assignment information. Therefore, the playing control unit reads out the playing part conforming to the playing part assignment information, and sound data items for this playing part is transmitted to the tone generator. Thus, each of the performance terminals plays music with the playing part conforming to the part assignment settings, thereby playing music ensemble as a whole.

If the number of playing parts is more than the number of performance terminals, the differences in the number of sounds of the playing parts may cause a significant imbalance in the total number of sounds of the playing parts assigned to each of the performance terminals, depending on the manner of assigning the playing parts (depending on the playing part assignment settings). Therefore, when an operation of assigning one or more of the playing parts to each of the performance terminals or an operation of reading out music data is performed, the playing part assignment unit counts the number of sound data items of each of the playing parts. It then sets the playing part assignment so that the number of sound data items assigned to each of the playing parts approximates the number of sound data items assigned to the other playing parts. Thus, the number of sound data items of playing parts assigned to each of the performance terminals can approximate the number of sound data items of playing parts assigned to the other performance terminals.

According to the fourth to ninth aspects of the present invention, the playing part assignment unit sequentially pairs the playing parts as a pair of playing parts with the largest number of sounds and the smallest number of sounds, a pair of playing parts with the second largest number of sounds and the second smallest number of sounds, and so on, and assigns these pairs to the playing parts. Thus, the number of sounds of playing parts assigned to each of the performance terminals can approximate the number of sounds of playing parts assigned to the other performance terminals.

According to the present invention, the number of sounds of playing parts assigned to each of the performance terminals can approximate the number of sounds of playing parts assigned to the other performance terminals. Therefore, the players of the performance terminals can play without the feeling of unfairness.

The above and other objects, features, and advantages of the invention will become more apparent from the following detailed description taken in conjunction with the accompanying drawings.

BRIEF DESCRIPTION OF THE DRAWINGS

FIGS. 4A and 4B are views which are useful in illustrating an example of a balanced change pattern;

FIG. 10 is a view showing an example of music data;

FIG. 14 is a view showing an example of a part assignment table.

DETAILED DESCRIPTION OF THE PREFERRED EMBODIMENTS

Referring to FIGS. 1 to 15, a music ensemble system according to an embodiment of the present invention will be described.

Figure 1:
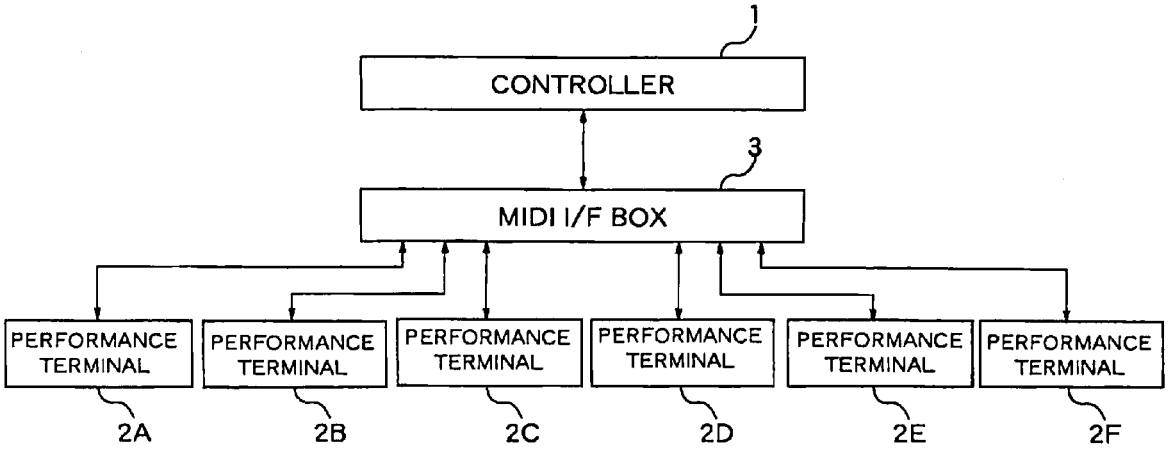
FIG. 1 is a block diagram showing the configuration of a music ensemble system according to an embodiment of the present invention.

FIG. 1 is a block diagram showing the configuration of a music ensemble system according to an embodiment of the present invention. This music ensemble system includes a controller 1 and a plurality of (six in FIG. 1) performance terminals 2 (2A to 2F) connected to the controller 1 via a MIDI interface box 3. For example, electronic keyboard instruments such as electronic pianos may be used for the performance terminals 2. In this embodiment, interfacing by the MIDI interface box 3 allows the respective performance terminals 2 to be connected to the controller 1 via a different MIDI system. The MIDI interface box 3 is connected with the controller 1 by USB.

In the music ensemble system according to this embodiment, the controller 1 controls playing of the performance terminals 2 so that each of the performance terminals 2A to 2F plays a different playing part. As described above, playing parts refer to parts such as melodies that constitute a piece of music ensemble. Playing parts may include, by way of example, one or more melody parts, rhythm parts, accompaniment parts for different instruments, and so on.

The controller 1 controls playing of the performance terminals 2 to perform semi-automatic playing. In the semi-automatic playing, playing is not entirely automatically performed by the performance terminals 2 but controlled by playing operations (e.g., operating any one key on the keyboard) performed by players on the performance terminals 2. Specifically, the playing tempo and the playing timing are adjusted according to the timing of the playing operations. The playing tempo refers to the progress speed of an entire piece of music, and the playing timing refers to the timing of producing sounds of notes.

Process in the semi-automatic playing will be briefly described below.

The performance terminal 2 is a keyboard instrument, and therefore has a keyboard with a plurality of keys (controls) and receives a playing operation upon operating of one of the keys. The performance terminal 2 has a function of communicating with the controller 1 and transmits to the controller 1 an operation signal indicating operation information (e.g., a Note On message of MIDI data) about this playing operation. While this operation information contains pitch information, the controller 1 in this embodiment ignores (filters out) the pitch information and uses the operation information as information indicating the timing of the playing operation.

Therefore, whichever key is pressed, the same operation signal is transmitted to the controller 1 as long as the key is pressed with the same timing and tempo. The player can adequately play music only by pressing any one key with appropriate timing, and this allows those inexperienced at playing a keyboard instrument to play music.

The controller 1 may be implemented by a personal computer, for example, and controls playing of the performance terminals 2 with software installed into the personal computer. Specifically, the controller 1 has stored thereon music data consisting of a plurality of playing parts. Before starting playing music together, the controller 1 assigns one (or more than one) playing part to each of the performance terminals 2A to 2F. The controller 1 has a function of communicating with the performance terminals 2, and based on the operation information input from each of the performance terminals 2, determines the tempo and timing for the playing part assigned to the performance terminal 2. The controller 1 reads out sound instruction data (MIDI data) for the part according to the determined tempo and timing and outputs the music data to the performance terminal 2.

Each of the performance terminals 2 inputs the sound instruction data received from the controller 1 to an internal tone generator and produces musical sounds. Thus, the performance terminal 2 produces musical sounds according to the tempo and timing designated by the player with the player's playing operation, and according to the playing part assigned by the controller 1.

In this embodiment, the timing of the playing operation for adequately playing together is common to all playing parts. This playing timing is indicated to the players by a facilitator (e.g., the player of the performance terminal 2A) serving as a guide, such as with a playing operation or with a direction using a physical (e.g., hand or foot) action. Playing operations performed according to this indication are supposed to be able to realize adequate music ensemble.

The performance terminals 2 are not limited to keyboard instruments such as electronic pianos but may be other forms of electronic instruments such as electronic guitars. Of course, they may not only have the appearance of natural instruments but also may be terminals having only controls such as buttons.

As described above, the controller 1 sets the assignment of the playing parts to the performance terminals 2. In this embodiment, the part assignment settings can be changed with a simple operation. The part assignment settings are changed by an operator of the controller 1 (such as the facilitator) typically manually using an operation unit 15 to be described later (see FIG. 8) for each of the parts and each of the performance terminals 2. Furthermore, the playing part assignment settings can be changed according to a predetermined change pattern only by operating a particular control (one of playing part changing controls B5 to be described later using FIG. 5).

In cases such as where a piece of music is played for a number of times, the parts assigned to the performance terminals 2 may be changed. This often does not require intentional part change by assigning specific parts to specific performance terminals 2. Rather, what is aimed at in the music ensemble playing may be to change the playing part assigned to each of the performance terminals 2 to any other part. Therefore, it would not provide high operability to manually change the individual assignment of the playing parts to the performance terminals 2 each time only for this aim. In this embodiment, as mentioned above, only operating a particular operator can cause the set assignment to be changed according to one of predetermined change patterns. Therefore, the playing parts assigned to the performance terminals 2 can be changed with high operability.

Now, the change patterns will be described below.

Figure 2A:
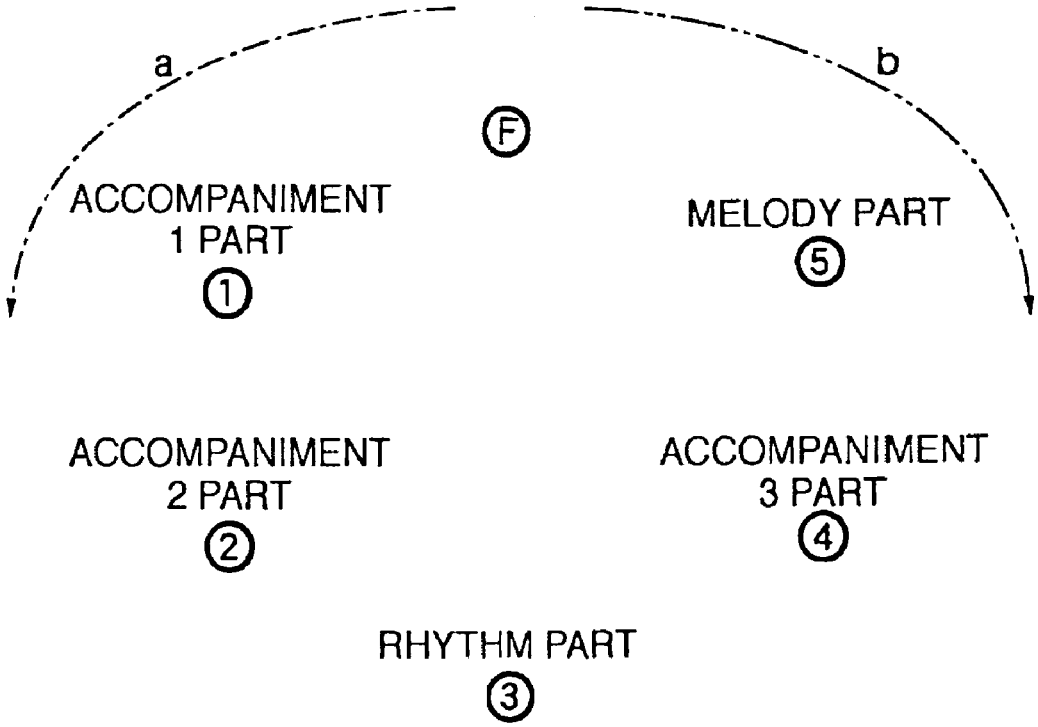
FIGS. 2A and 2B are views which are useful in illustrating an example of forward or backward shift.
Figure 2B:
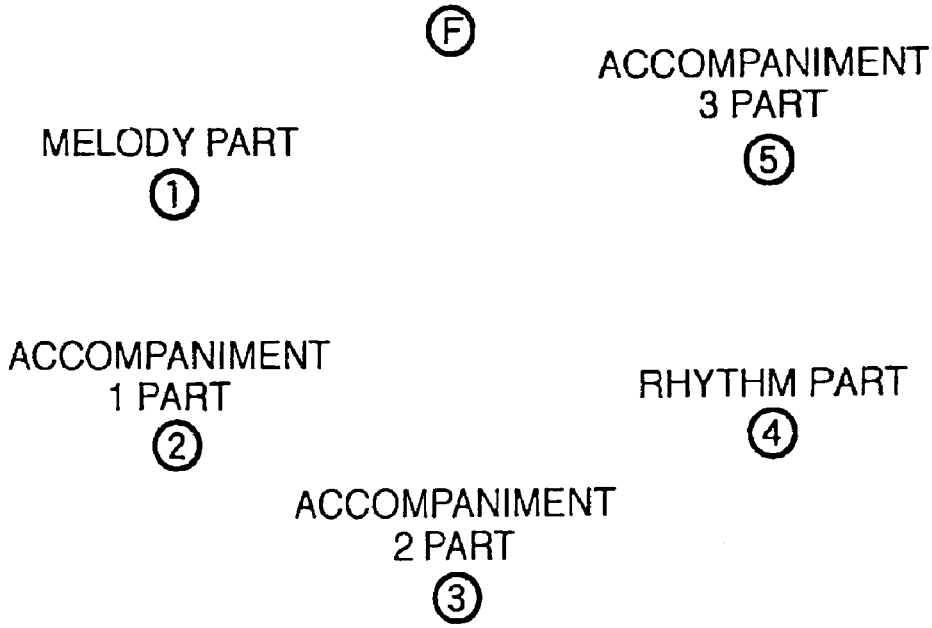

FIGS. 2A and 2B are views which are useful in illustrating an example of a change pattern (forward or backward shift) for changing the part assignment settings. FIG. 2A is for illustrating the part assignment settings before the change, and FIG. 2B is for illustrating the part assignment settings after the change.

Each of the performance terminals 2 is provided with a terminal ID (identifier). Here, the performance terminal 2A is provided with a terminal ID 0, the performance terminal 2B is provided with a terminal ID 1, the performance terminal 2C is provided with a terminal ID 2, the performance terminal 2D is provided with a terminal ID 3, the performance terminal 2E is provided with a terminal ID 4, and the performance terminal 2F is provided with a terminal ID 5.

Each of the performance terminals 2 is also assigned a playing part. In FIG. 2A, the performance terminal 2A is assigned a "facilitator F", the performance terminal 2B is assigned an "accompaniment 1 part", the performance terminal 2C is assigned an "accompaniment 2 part", the performance terminal 2D is assigned a "rhythm part", the performance terminal 2E is assigned an "accompaniment 3 part", and the performance terminal 2F is assigned a "melody part". Typically, the performance terminal 2A used by the facilitator is not assigned any playing parts.

These playing part assignment settings may be managed as, for example, information in a table form as shown in FIG. 14 (part assignment information according to the present invention). That is, each of the performance terminals 2 is provided with a terminal ID (identifier), which is registered in the table in association with a corresponding playing part assigned to that performance terminal 2. The terminal IDs are unique identifiers and indicate the order of the terminal IDs "0 to 5" described above.

When a forward shift button B51 (see FIG. 5), which instructs a forward shift for shifting the playing parts in the order of the terminal IDs of the performance terminals 2, is pressed (clicked by a mouse), the controller 1 shifts the playing part assignment by a predetermined number (here, only one) in the order indicated by the terminal IDs "0 to 5" (i.e., in the order indicated by a chain line a) (see FIG. 2B). Since the terminal ID 0 corresponds to the facilitator's performance terminal, the playing part shift is not performed for this performance terminal.

When a backward shift button B52 (see FIG. 5), which instructs a backward shift for shifting the playing parts in the reverse order of the terminal IDs of the performance terminals 2, is pressed (clicked by a mouse), the controller 1 shifts the assignment of the playing parts by a predetermined number (here, only one) in the reverse order of the order indicated by the terminal IDs "0 to 5" (i.e., in the order indicated by a two-dot chain line b).

As described above, in the forward or backward shift, the assignment of the playing parts is shifted in the normal or reverse order of the identifiers of the performance terminals 2 every time the forward shift button B51 or the backward shift button B52 is pressed. This allows each of the performance terminals 2 to be assigned a different playing part until the first playing part comes full circle and is assigned again to its original performance terminal 2.

Figure 3A:
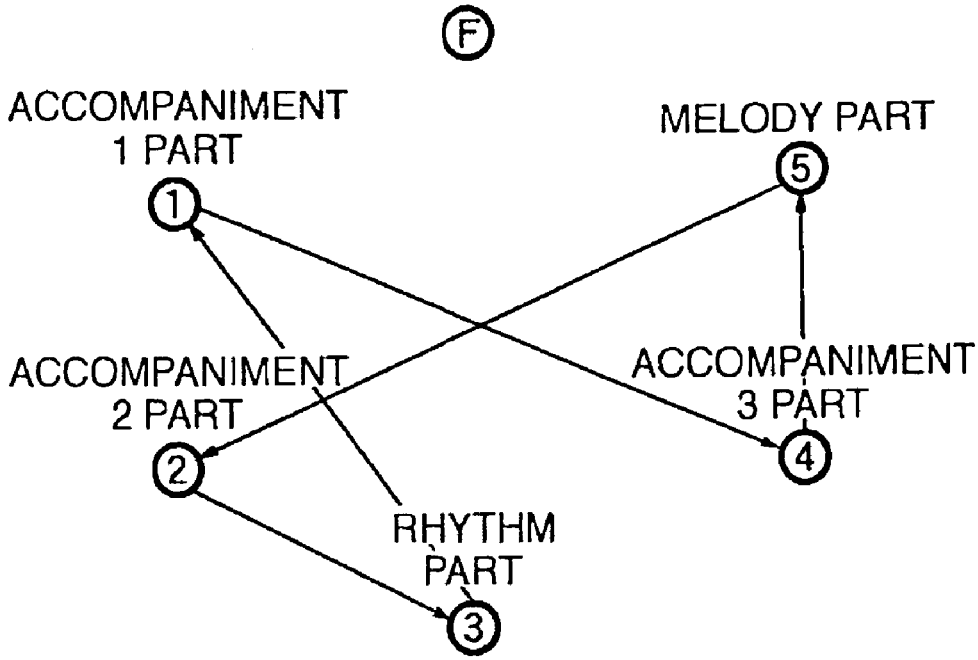
FIGS. 3A and 3B are views are useful in illustrating an example of a random change pattern.
Figure 3B:
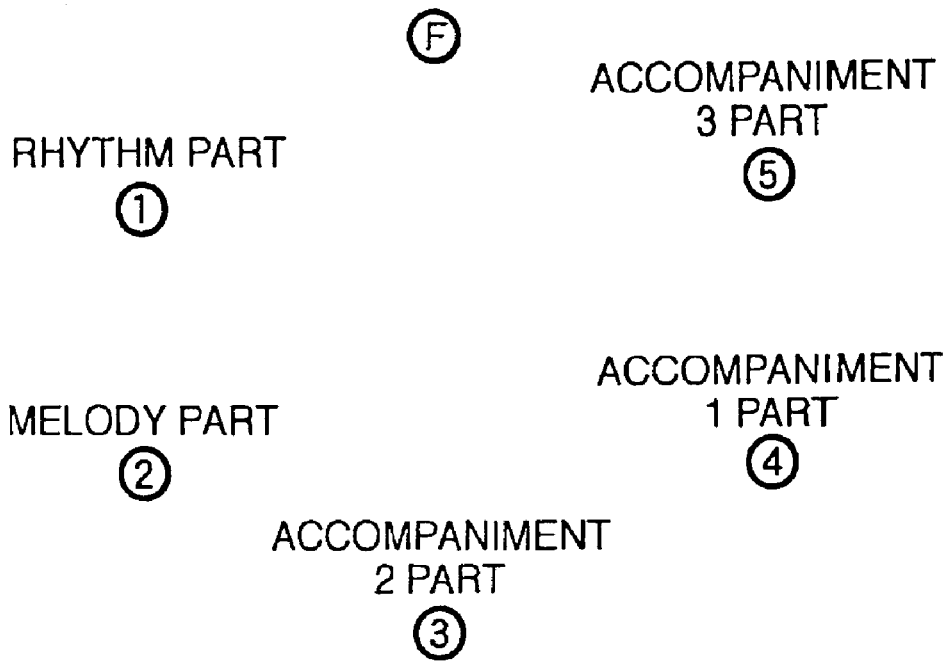

FIGS. 3A and 3B are views which are useful in illustrating an example of a change pattern (random change pattern) for changing the assignment of the playing parts to the performance terminals 2. FIG. 3A is for illustrating the assignment before the change, and FIG. 3B is for illustrating the assignment after the change.

When a random change button B53 (see FIG. 5) is pressed, the playing part assignment is changed according to the random change pattern. In the random change pattern, the assignment of the playing parts to the performance terminals 2 is changed at random (see FIG. 3B) as indicated by arrows in FIG. 3A. Since the players cannot predict the next playing part, they can enjoy guessing which will be assigned next.

FIGS. 4A and 4B are views which are useful in illustrating an example of a change pattern (balanced change pattern) for changing the assignment of the playing parts to the performance terminals 2. FIG. 4A is for illustrating the assignment before the change, and FIG. 4B is for illustrating the assignment after the change.

Unlike the above-described forward and backward shift and random change pattern, this balanced change pattern does not aim to simply change the playing parts assigned to the performance terminals 2. In the above examples, each of the performance terminals 2 is assigned one playing part. When each of the performance terminals is assigned more than one playing part, a significant imbalance may be created in the total number of sounds of playing parts assigned to each of the performance terminals 2. The balanced change pattern aims to adjust the assignment of the playing parts to the performance terminals 2 for correcting this imbalance.

FIG. 4 shows an example of the playing part assignment in the absence of the players for the "terminal ID 4" and "terminal ID 5". As shown in FIG. 4A, the "terminal ID 1" is assigned the "accompaniment 1 part" with 10 sounds (the number of sound data items of the playing part), the "rhythm part" with 1000 sounds, and the "melody part" with 2000 sounds. Therefore, the total number of sounds assigned to the "terminal ID 1" is 10+1000+2000=3010.

The "terminal ID 2" is assigned only the "accompaniment 2 part" with 20 sounds, and therefore the number of sounds assigned to the "terminal ID 2" is 20. The "terminal ID 3" is assigned the "accompaniment 3 part" with 100 sounds and the "accompaniment 4 part" with 200 sounds. Therefore, the number of sounds assigned to the "terminal ID 3" is 100+200=300.

Thus, the total number of sounds assigned to the "terminal ID 1", "terminal ID 2", and "terminal ID 3" is 3010, 20, and 300 respectively, resulting in an imbalance.

Here, when a balanced change operation button B54 is pressed, the playing part assignment is changed according to the balanced change pattern. In the balanced change pattern, if the number of playing parts is less than twice the number of performance terminals 2, the playing parts are assigned one by one to the performance terminals "terminal ID 1", "terminal ID 2", and "terminal ID 3" in decreasing order of the number of sounds of the respective playing parts.

If unassigned playing parts exist after the above processing, a playing part with the largest number of sounds among the remaining playing parts is assigned to a performance terminal 2 with the smallest total number of sounds (assignment processing for a small number of playing parts). This assignment processing for a small number of playing parts is repeated until all playing parts are assigned to the performance terminals 2.

If the number of playing parts is not less than twice the number of performance terminals 2 to which the playing parts are to be assigned, a pair consisting of a playing part with the largest number of sounds—n (the subscript n is a positive integer or 0 assigned in decreasing order of the number of sounds) and a playing part with the smallest number of sounds—n (the subscript n is a positive integer or 0 assigned in increasing order of the number of sounds) is sequentially assigned to each of the performance terminals 2. Specifically, a playing part with the largest number of sounds (in this example, the melody part with 2000 sounds) and a playing part with the smallest number of sounds (in this example, the playing part with 10 sounds) are assigned to any one performance terminal 2 (in this example, the "terminal ID 1").

A playing part with the next largest number of sounds (in this example, the rhythm part with 1000 sounds) and a playing part with the next smallest number of sounds (in this example, the accompaniment 2 part with 20 sounds) are assigned to another performance terminal 2 (in this example, the "terminal ID 2"). Further, a playing part with the next largest number of sounds (in this example, the accompaniment 4 part with 200 sounds) and a playing part with the next smallest number of sounds (in this example, the accompaniment 3 part with 100 sounds) are assigned to still another performance terminal 2 (in this example, the "terminal ID 3").

In this manner, a pair of playing parts with the largest and smallest number of sounds is sequentially assigned to each of the performance terminals 2. When this assignment of playing part pairs to the performance terminals 2 has finished, there may be playing parts still remaining to be assigned. If the number of remaining playing parts is not less than twice the number of performance terminals 2, this processing is repeated until the number of remaining playing parts becomes less than twice the number of performance terminals 2. If the number of remaining playing parts is less than twice the number of performance terminals 2, the above-described assignment processing for a small number of playing parts is performed until there are no remaining playing parts.

In the above-described balanced change pattern, the imbalance in the total number of sounds of the playing parts assigned to each of the performance terminals 2 is corrected. This alleviates the feeling of unfairness of the players due to the imbalance in the total number of sounds among the performance terminals 2.

To guide a user in inputting an instruction to change the playing parts according to the above-described various change patterns or in selecting music ensemble, a main operation window W1 is displayed on the controller 1. This main operation window W1 will be described below.

Figure 5:
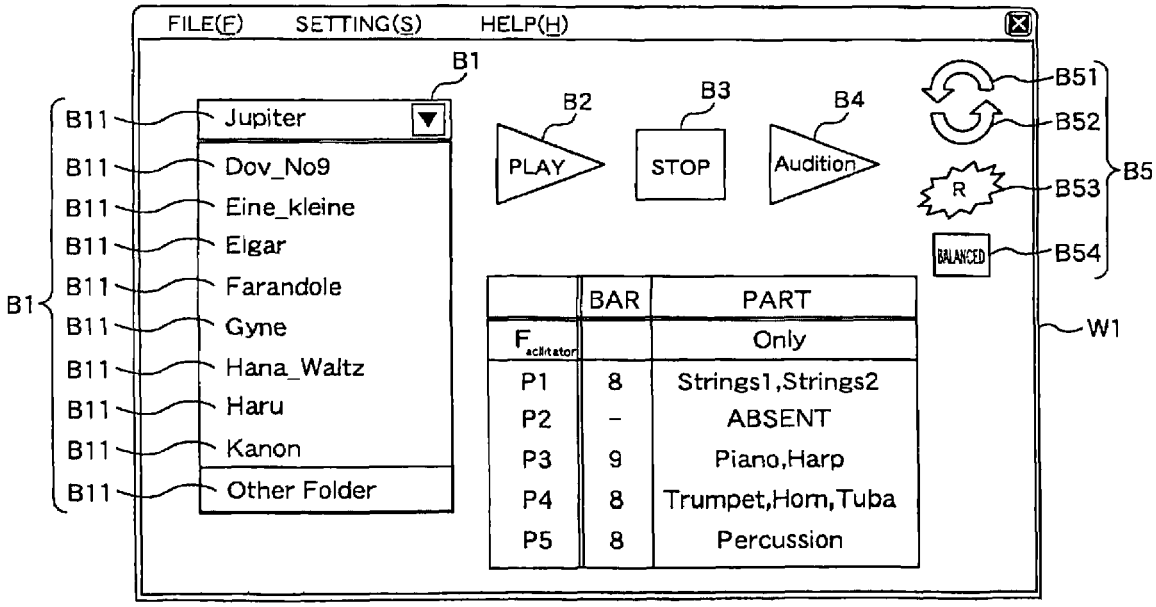
FIG. 5 is a view showing an example of a main operation window.

FIG. 5 is a view showing an example of the main operation window W1 displayed on the controller 1. Music selection buttons B11 indicating music ensemble titles are displayed for a plurality of pieces of music ensemble at the left end of the main operation window W1. These music selection buttons B11 will collectively be described as a music selection button group B1. Clicking on a music selection button on the title of a desired piece of music ensemble by the facilitator or the like with a mouse operation causes selection of the piece of music ensemble.

Displayed at the upper right of the main operation window W1 are a PLAY button B2, a STOP button B3, and an AUDITION button B4 in this order from the left. Clicking on the PLAY button B2 by the facilitator or the like with a mouse operation causes starting of playing process of the selected music ensemble. Clicking on the STOP button B3 by the facilitator or the like with a mouse operation causes termination of the playing processing or audition processing (to be described below) of the music ensemble. Clicking on the AUDITION button B4 by the facilitator or the like with a mouse operation causes starting of the audition processing for allowing the players to listen to the selected music ensemble.

Part change operators B5 are displayed in a vertical row to the right of the AUDITION button B4. The part change operators B5 include the forward shift button B51, the backward shift button B52, the random change button B53, and the balanced change operation button B54, which are displayed in this order.

Clicking on (pressing) the forward shift button B51 by the facilitator or the like with a mouse operation causes the above-described processing for changing the assignment of the playing parts to the performance terminals 2 with a forward shift (forward assignment change process). Clicking on (pressing) the backward shift button B52 by the facilitator or the like with a mouse operation causes the above-described processing for changing the assignment of the playing parts to the performance terminals 2 with a backward shift (backward assignment change process).

Clicking on (pressing) the random change button B53 by the facilitator or the like with a mouse operation causes the above-described process for changing the assignment of the playing parts to the performance terminals 2 according to the random change pattern (random assignment change process). Clicking on (pressing) the balanced change operation button B54 by the facilitator or the like with a mouse operation causes the above-described processing for changing the assignment of the playing parts to the performance terminals 2 according to the balanced change pattern (balanced assignment change process).

Displayed at the lower right of the main operation window W1 are the part assignment settings for the "facilitator F (terminal ID 0)" and "P1 to 5 (terminal IDs 1 to 5)" (in this example, the assignment settings of "Strings 1", "Strings 2", "Piano", "Harp", "Trumpet", "Horn", "Tuba", and "Percussion"), as well as the absence settings for the players "facilitator F" and "P1 to 5".

Displayed at the top of the main operation window W1 are File (F), Setting (S), and Help (H) in this order from the left. Clicking on the Setting (S) causes display of items such as "Select MIDI Keyboards", "Manually Assign Playing Parts", and "Set the Number of Beats". Clicking on the "Select MIDI Keyboards" causes display of a window W3 for selecting MIDI keyboards to be described later. Clicking on the "Manually Assign Playing Parts" causes display of a window W2 for manually assigning the playing parts to be described later.

Selecting the "Set the Number of Beats" causes display of a window for setting the number of beats in a bar (the above-described specific operation timing). In this window, the facilitator or the like provides an input to set the number of beats in a bar. For example, when music is to be played based on music data of four-four time, a key will be pressed on every beat if the number of beats is set to four. Also for this music, a key will be pressed on every other beat if a radio button for two beats is selected, and therefore the first and third beats will be the key-press timing. In this case, in response to a Note On message and a Note Off message transmitted from the performance terminals 2, the controller 1 returns sound instruction data of the length of two beats. That is, music of the length of two beats will be played by one key-press.

An icon "x" is displayed in the upper right corner of the main operation window W1. When the icon "x" is clicked, the main operation window W1 is closed, followed by terminating an application for performing music ensemble in the music ensemble system in this embodiment.

Figure 6:
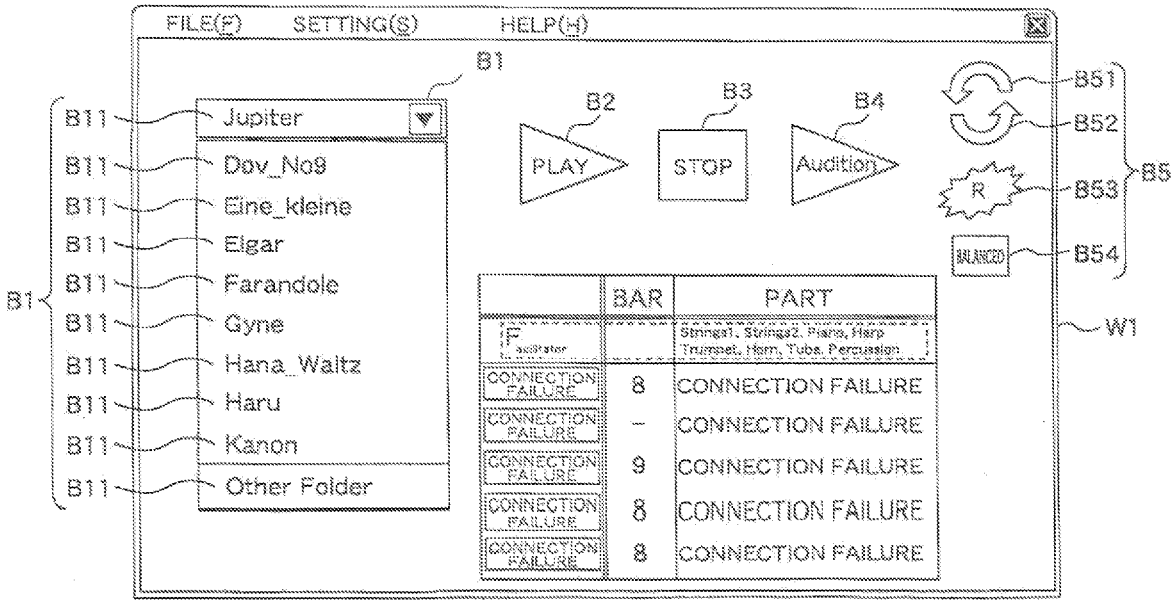
FIG. 6 is a view showing an example of a manual assignment window displayed when a connection failure occurs.

FIG. 6 shows an example of a screen displaying to the facilitator connection failures between the controller 1 and the performance terminals 2 (e.g., driver failures due to the personal computer of the controller 1 entering sleep mode). Although the connection failures are indicated individually for each of the performance terminal 2 in FIG. 6, it is also possible to display a connection failure over the window if any one connection failure occurs. When this screen is displayed, the system may be manually or automatically powered on to restart. Alternatively, if music ensemble is being played, operations (producing sounds) by a performance terminal 2 involved in a connection failure may be stopped. The part assigned to this performance terminal 2 may be automatically played or manually played by the facilitator to prevent the whole music ensemble from being interrupted.

Figure 7:
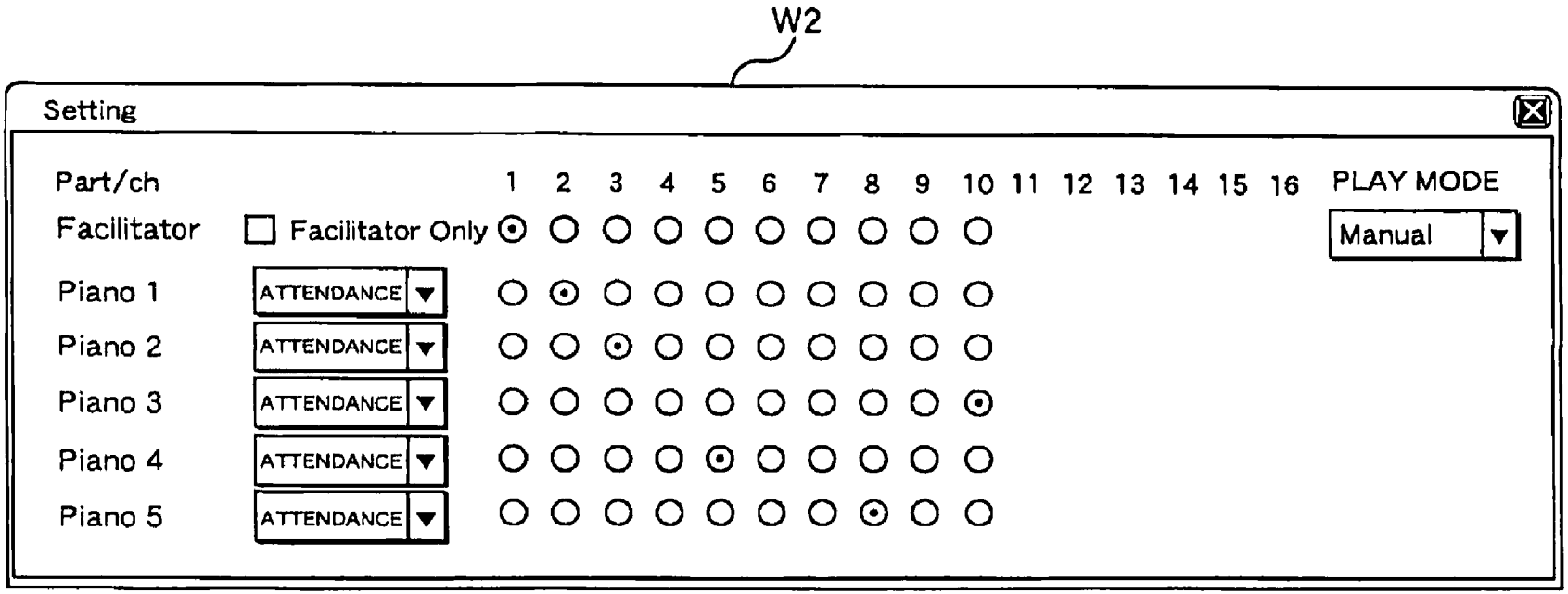
FIG. 7 is a view showing an example of the manual assignment window.

FIG. 7 is a view showing an example of the manual assignment window W2.

In the manual assignment window W2, a pull-down menu for selecting the presence or absence and radio buttons for assigning a playing part are displayed for each of "Facilitator (similar to the above-described facilitator F)" and "Piano 1 to 5 (similar to the above-described P1 to 5)". The "Facilitator" and "Piano 1 to 5" are each associated with a MIDI port of the MIDI interface box 3. Once the performance terminals 2 are connected to the MIDI ports, the performance terminals 2 are associated with the "Facilitator" and "Piano 1 to 5" respectively.

Figure 8:
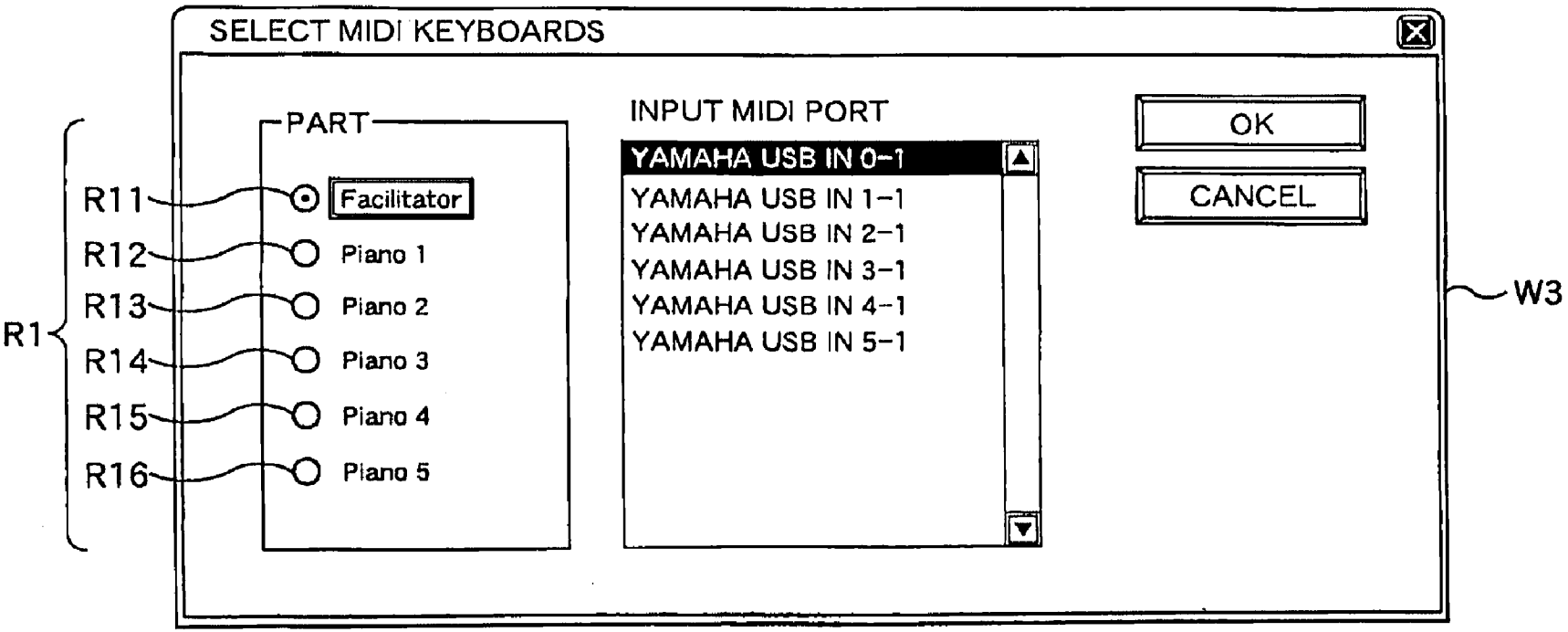
FIG. 8 is a view showing a MIDI port selection window.

As shown in FIG. 8, the facilitator may also manually select MIDI ports to be associated with the "Facilitator" and "Piano 1 to 5" in the MIDI keyboard selection window W3.

The playing parts and MIDI ports may be manually selected when, for example, settings are made according to the characteristics of players of the performance terminals 2 (preferences, mannerisms, accuracy of playing, etc.) or according to the aim of playing together intended by the facilitator (playing mainly the melody together, purposely assigning a rhythm part to a player weak at playing in rhythm, etc.)

In FIG. 7, the pull-down menus for the presence or absence are selected and input by the facilitator with a mouse operation according to the presence or absence of the players. The number of displayed radio buttons is equal to the product of the number of playing parts in the selected music ensemble and the number of performance terminals 2 that are set as present. No radio button is displayed for the performance terminals 2 that are set as absent on the pull-down menus, so that no playing part is assigned to these performance terminals 2.

In the example of FIG. 7, the music data on the selected music ensemble include playing parts 1 to 10. Once the music ensemble is selected, the playing parts 1 to 10 are automatically assigned to the present performance terminals 2 according to default settings. At this point, the user (facilitator) operating the controller 1 may select the radio buttons to manually assign the playing parts to desired performance terminals.

Typically, the facilitator is assigned no playing part by default. However, the facilitator may be assigned a playing part in order to indicate the operation timing to the players of the other performance terminals 2. Selecting a checkbox for Facilitator only causes all playing parts to be assigned to the Facilitator.

Now, the configuration of the controller 1 and the performance terminals 2 will be described in detail below.

Figure 9:
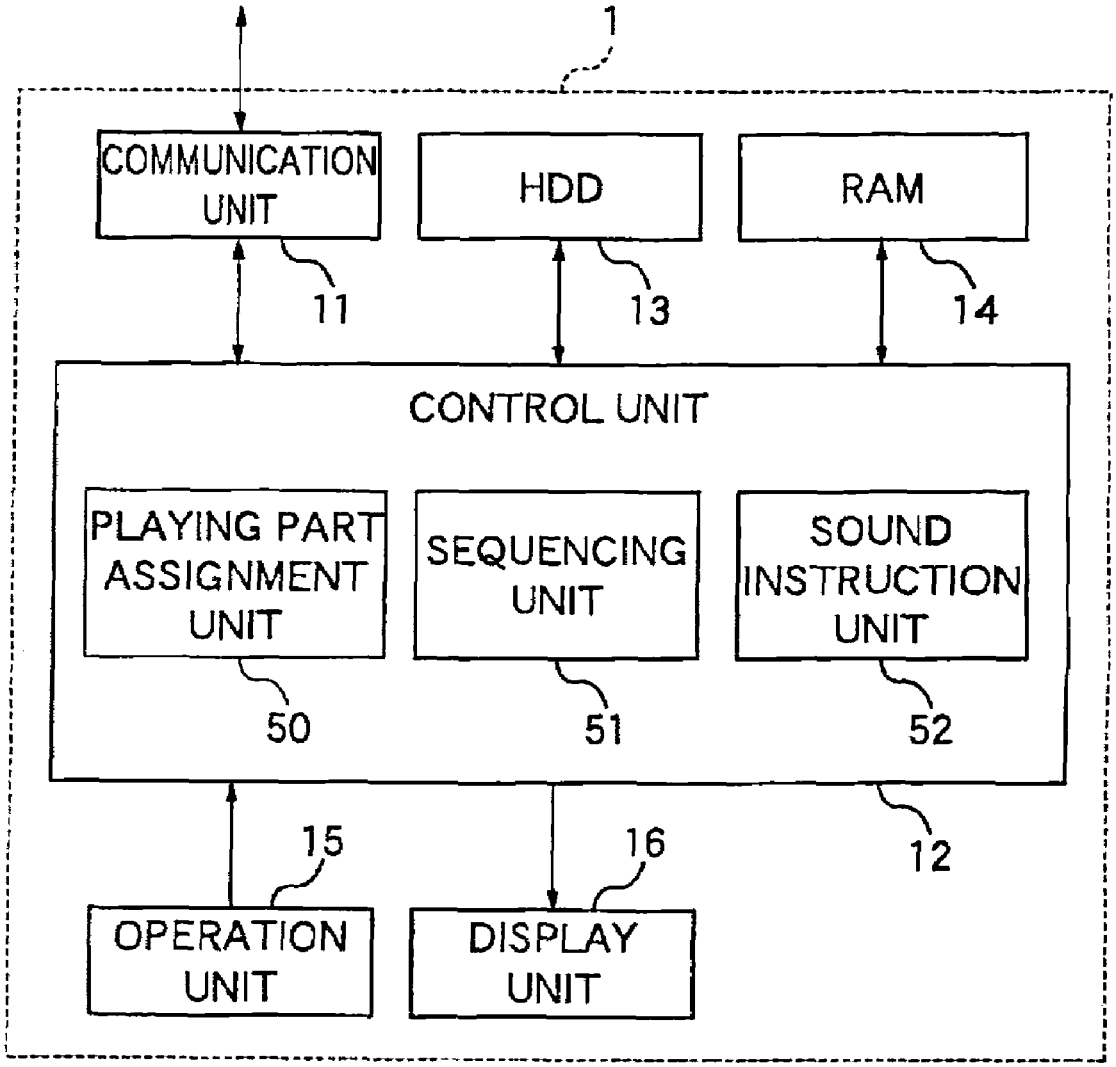
FIG. 9 is a block diagram showing the configuration of a controller.

FIG. 9 is a block diagram showing the configuration of the controller 1. As shown, the controller 1 includes a communication unit 11, a control unit 12, an HDD 13, a RAM 14, an operation unit 15, and a display unit 16. The communication unit 11, the HDD 13, the RAM 14, the operation unit 15, and the display unit 16 are connected to the control unit 12.

The communication unit 11 is a circuit unit that communicates with the performance terminals 2, and has a USB interface to which the MIDI interface box 3 is connected. The communication unit 11 communicates with the six performance terminals 2 via this MIDI interface box 3 and MIDI cables.

The HDD 13 contains an operating program for the controller 1, and music data for a plurality of pieces of music ensemble. Each piece of music data consists of a plurality of playing parts. The music data is data (a standard MIDI file) prepared based on the MIDI standard and is stored in the HDD 13 of the controller 1. FIG. 10 shows an example of the music data. As shown, the music data consists of a plurality of playing parts, each including identification information (a part ID) identifying the playing part and playing information about the playing part.

The music data may be stored at the shipping stage, or may be stored after shipping such as by downloading it using the communication unit 11 from an external apparatus (not shown) via a network. The music data may not necessarily be stored for a plurality of pieces of music ensemble, but may be stored for only one piece of music.

The control unit 12 reads out the operating program stored in the HDD 13 and loads it into the RAM 14 serving as work memory. The control unit 12 includes function units such as a playing part assignment unit 50, a sequencing unit 51, and a sound instruction unit 52.

The playing part assignment unit 50 functions as a playing part assignment unit and a playing part changing unit according to the present invention. The playing part assignment unit 50 performs processing of setting the part assignment settings in the sequencing unit 51 according to default settings, and processing of changing the part assignment settings in the sequencing unit 51 (playing part assignment process). Details of this playing part assignment process will be described later using FIGS. 11 to 15.

The sequencing unit 51 stores part assignment information representing the assignment of the playing parts to the performance terminals 2. Based on this part assignment information, the sequencing unit 51 reads out a playing part corresponding to a performance terminal 2 that has transmitted an operation signal. It then sequences the read-out playing part (determines the pitch, length, etc. of each sound) according to the tempo and timing indicated by the operation signal. Details of the sequencing will be described later. The sound instruction unit 52 transmits the pitch, length, etc. of each sound determined by the sequencing unit 51 as sound instruction data to the performance terminal 2.

The operation unit 15 is used by a user (mainly the facilitator) to instruct operations of this playing system. The facilitator operates the operation unit 15 and, for example, designates music ensemble to play or assigns the playing parts to the performance terminals 2. The display unit 16 includes what is called a display (monitor), and it provides display such as the above-described main operation window W. With the guide of the display on the display unit 16, the facilitator or each user selects music ensemble, inputs and changes the part assignment settings, and inputs the specific operation timing. The display on the display unit 16 is controlled by the control unit 12.

Figure 11:
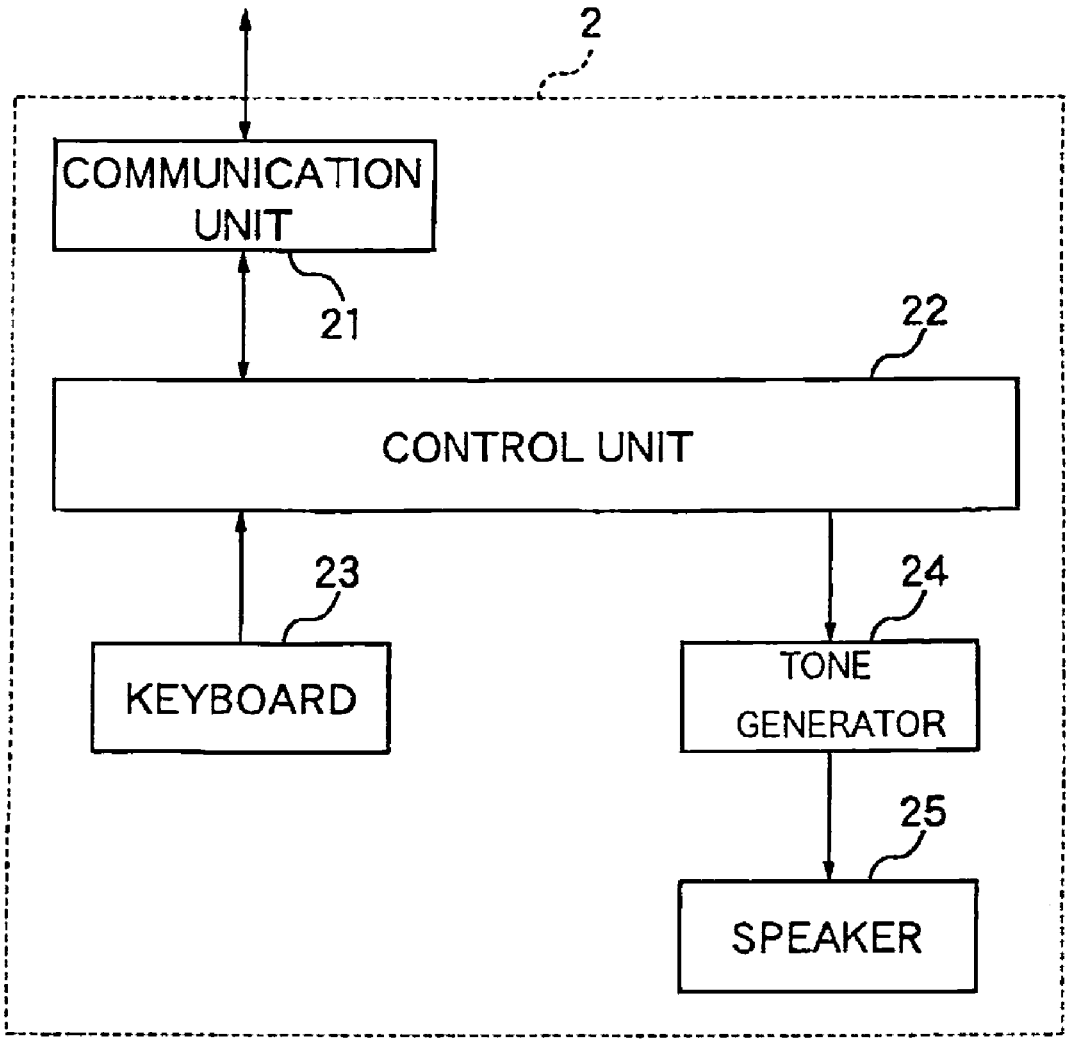
FIG. 11 is a block diagram showing the configuration of a performance terminal.

FIG. 11 is a block diagram showing the configuration of the performance terminal 2. As shown, the performance terminal 2 includes a communication unit 21, a control unit 22, a keyboard 23 serving as playing controls, a tone generator 24, and a speaker 25. The communication unit 21, the keyboard 23, and the tone generator 24 are connected to the control unit 22. The speaker 25 is connected to the tone generator 24.

The communication unit 21 is a MIDI interface and communicates with the controller 1 via a MIDI cable. The control unit 22 centrally controls the performance terminal 2. The keyboard 23 has, for example, 61 or 88 keys and can play in 5 to 7 octaves. However, this music ensemble system does not discriminate among the keys and uses data about Note On/Note Off messages and the key-press intensity (Velocity). That is, each key includes a sensor for detecting on/off and a sensor for detecting the key-press intensity. The keyboard 23 outputs an operation signal to the controller 22 according to the key operation state (e.g., which key was pressed at which intensity). If the discrimination among the keys is necessary for the purpose of music ensemble playing (e.g., when music ensemble is played by pressing the keys with particular fingers), key identification data (note numbers) may be used together. The note numbers may be ignored (filtered out) if the discrimination among the keys is not necessary.

The control unit 22 transmits a Note On message and a Note Off message to the controller 1 via the communication unit 21 based on the input operation signal. The tone generator 24 generates a sound waveform under the control of the control unit 22 and outputs it as an audio signal to the speaker 25. The speaker 25 reproduces the audio signal input from the tone generator 24 to provide musical sounds. The tone generator and the speaker may not be included in the performance terminal 2. The tone generator and the speaker may be connected to the controller 1 so that musical sounds are provided at a place different from where the performance terminal 2 is. While as many tone generators as the performance terminals 2 may be connected to the controller 1, a single tone generator may also be used. If as many tone generators as the performance terminals 2 are connected, the controller 1 may assign the parts of the music data by associating the tone generators with respective performance terminals 2.

In the above-described operation, upon pressing of a key on the keyboard 23, the control unit 22 transmits Note On/Note Off messages to the controller 1 and produces musical sounds according to an instruction from the controller 1 (Local Off) rather than according to the note messages from the keyboard 23. Besides this operation, the performance terminal 2 may of course be used as a general electronic instrument. That is, upon pressing of a key on the keyboard 23, the control unit 22 may not transmit note messages to the controller 1 but instruct the tone generator 24 to produce musical sounds based on the note messages (Local On).

Switching between Local On mode and Local Off mode may be performed by a user using the operation unit 15 of the controller 1 or using a terminal operation unit (not shown) on the performance terminal 2. It is also possible to set only some keyboards as Local Off and the other keyboards as Local On.

Now, referring to FIGS. 5, 9, and 11, operations for the above-described music ensemble system to play music ensemble will be described.

In the controller 1, when the operation unit 15 receives an instruction from a user (particularly the facilitator), the control unit 12 starts an application for playing music ensemble. The control unit 12 then displays the main operation window W1 as shown in FIG. 5 on the display unit 16. Once the operation unit 15 receives selection of one of pieces of music ensemble (music data) from the user (particularly the facilitator), the part assignment unit 50 is informed of the selected music data.

The controller 1 refers to the header section of the music data about the selected music ensemble among music data items stored in the HDD 13 and obtains playing parts included in the music ensemble. The controller 1 performs the playing parts assignment process (to be described later) for the obtained playing parts by using the playing part assignment unit 50. If a selection operation cannot be received, playing parts are obtained for default music data and the playing part assignment process is performed. This playing part assignment process will be described later using FIGS. 12 to 15.

When the PLAY button B2 is pressed, the controller 1 reads out the music data from the HDD 13 to the RAM 14 to be ready for music playing operations. Once this state is entered, the players of the performance terminals 2 can play music. In this music ensemble system, the facilitator (the leader of the music ensemble playing) indicates the operation timing with a direction using a physical (e.g., hand or foot) action, or with a playing operation, and the players perform playing operations according to the indicated operation timing. That is, the users play according to the indication of the facilitator rather than merely play along with sample music (mechanical demo music). Therefore, the users can feel that they are actually playing music together.

Description will be given of operations of the music ensemble system during music ensemble playing. Upon operating by a finger of each user on a control (key) on the keyboard 23 of the user's performance terminal 2, the controller 22 transmits a Note On message to the controller 1 according to the intensity of the key press. The Note On message contains information such as the key-press intensity (Velocity). When the key on the keyboard 23 is released (the finger is lifted from the key), the controller 22 transmits a Note Off message to the controller 1.

In the controller 1, based on the Note On message and Note Off message received from the performance terminal 2, the sequencing unit 51 sequences music data of a predetermined length (e.g., the length of one beat, which is half the length of a bar if the number of beats in a bar is set to two) for a playing part assigned to this performance terminal 2.

Specifically, upon input of the Note On message, the sequencing unit 51 reads out playing information corresponding to the above predetermined length about the relevant playing part in music data. It then determines the timing, tone, effect, pitch change, and so on of the sounds to be produced.

Thus, while the sequencing unit 51 determines the sound intensity from the Velocity information in the Note On message, the playing information in the read-out music data contains information indicating the sound volume and the sequencing unit 51 determines the sound intensity by multiplying the sound volume by the Velocity information. That is, while the music data already contains the volume information reflecting the volume representation (sound dynamics) in the music, the dynamics representation depending on the user's key-press intensity is added to the volume information to determine the sound intensity.

The sequencing unit 51 also determines the tempo and the length of sounds based on the time period from the reception of the Note On message to the reception of the Note Off message. The sequencing unit 51 times the period from the reception of the Note On message to the reception of the Note Off message. For a sound to be produced first in the read-out music data of the predetermined length, the sequencing unit 51 determines the length of the sound to be the length from the input of the Note On message to the input of the Note Off message. For a sound to be produced next, the sequencing unit 51 determines the tempo for the length of corresponding beats and the length of the sound based on the measured time period.

Although the sequencing unit 51 may determine the tempo and the length of sounds based on the time period from the Note On to the Note Off (referred to as a GateTime), it may also determine the tempo as follows. The moving average of the GateTime is computed for a plurality of key presses (the last and the several preceding key presses) and weighted by time. The weight is the heaviest on the last key press, and the earlier the key press is, the lighter the weight thereon is. Determining the tempo in this manner prevents a sudden tempo change even if one key press causes a significant change in the GateTime. Therefore, the tempo can be smoothly changed according to the flow of the music.

The sound instruction unit 52 generates sound instruction data based on the sequencing by the sequencing unit 51. The sound instruction data is data instructing the timing of producing the sounds, the length of the sounds, the intensity, the tone, the effect, the pitch change (Pitch Bend), the tempo, and so on. The communication unit 11 transmits the generated sound instruction data to the performance terminal 2.

In the performance terminal 2, the controller 22 receives the sound instruction data via the communication unit 21 and instructs the tone generator 24 to generate a sound waveform. The tone generator 24 generates a sound waveform and reproduces musical sounds from the speaker 25. The above processing is repeated every time each user presses a key, so that music can be played by pressing a key, for example for every beat.

As described above, a musical sound first produced in a bar is instructed to continue until the Note Off message is input. Therefore, the tone generator 24 keeps on producing the same musical sound until the user lifts his finger from the key. This realizes sustained-sound representation (fermata) in this music ensemble playing system.

It is also possible to realize the following playing representation in the tone generator 24 by determining the tempo based on the moving average of the GateTime in the above-described manner. For example, in the sequencing unit 51 when a specific key is briefly pounded, the length of each sound for the corresponding beats is determined to be short, whereas when the specific key is pressed for a long duration, the length of each sound for the corresponding beats is determined to be long. Thus, the tone generator 24 can realize the playing representation of crisp sounds (staccato) without a significant change in the tempo, and the playing representation of sustained sounds (tenuto) without a significant change in the tempo.

In this embodiment, the same Note On message and Note Off message are transmitted to the controller 1 irrespective of which key is pressed. Alternatively, the keys on the keyboard 23 may be divided into those that enable the above-described staccato and tenuto and those that do not. The controller 1 may change the length of sounds while maintaining the tempo only when the Note On message and Note Off message are input from specific keys (e.g., E3).

Figure 12:
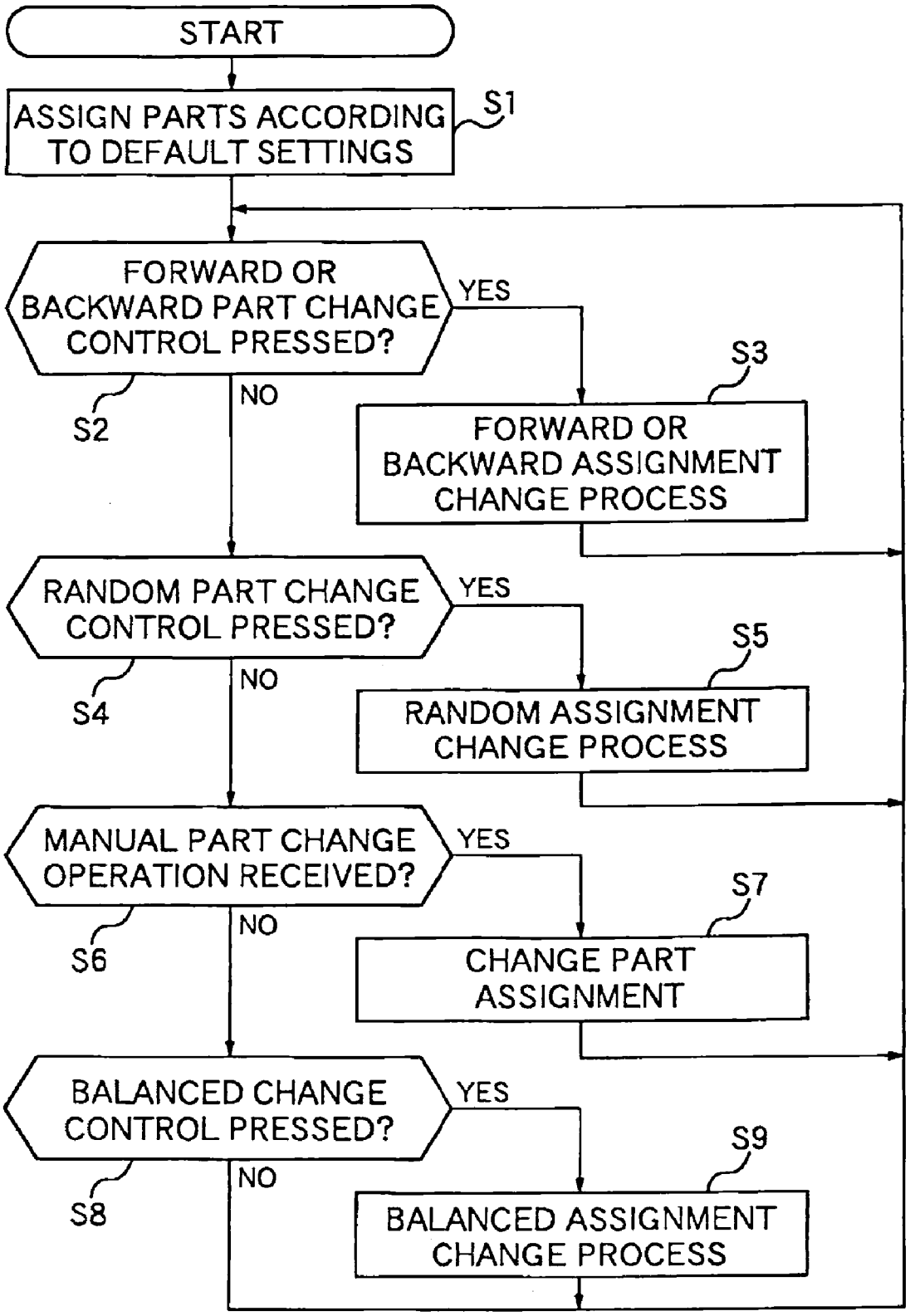
FIG. 12 is a flowchart showing the procedure of an example of a playing part assignment process.

Now, the playing part assignment processing will be described below using FIGS. 12 to 15. FIG. 12 is a flowchart showing an example of the playing part assignment process. First, the playing part assignment unit 50 assigns obtained playing parts to the performance terminals 2 according to default settings and sets this assignment in the sequencing unit 51 (step S1). For example, a table T as shown in FIG. 14 is stored in the HDD 13. The table T may be stored in the HDD 13 at the shipping stage, or may be stored after shipping by downloading it from an external apparatus.

As the default settings, identification information (part ID) on each playing part is registered in the table in association with a terminal ID of a performance terminal 2 to be assigned that playing part. The terminal ID is provided for each of the performance terminals to which a playing part is assigned, and it is an ID (terminal ID) of a MIDI port to which the performance terminal is connected. The MIDI port number indicates the port number in the MIDI interface box 3, and each of the performance terminals 2 is identified by the MIDI port to which it is connected.

As described above, the terminal ID is unique to each MIDI port, i.e., each of the performance terminals ("Facilitator 0" and "P1 to 5"), and indicates the order of the performance terminals 2.

Figure 13:
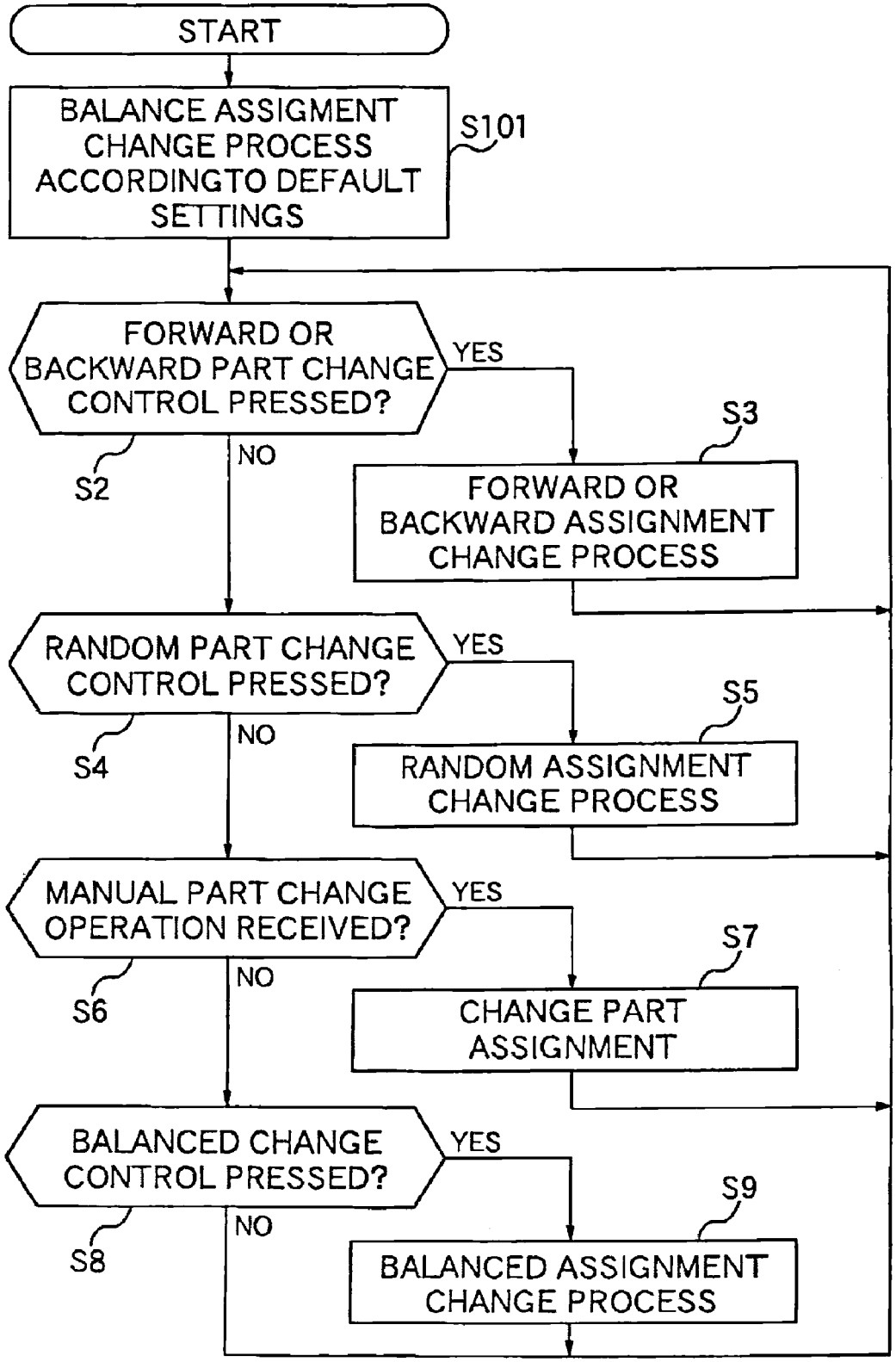
FIG. 13 is a flowchart showing the procedure of another example of a playing part assignment process.

In the example of FIG. 13, a MIDI port 1 (terminal ID 1) corresponds to the playing part 1, so that the playing part 1 is assigned to the performance terminal 2B in FIG. 1, for example. Similarly, a MIDI port 2 (terminal ID 2) corresponds to the playing part 2, so that the playing part 2 is assigned to the performance terminal 2C in FIG. 1, for example. In this manner, the playing parts are automatically assigned to the respective performance terminals 2. The registration content of this table has been registered in advance in the controller 1 by the facilitator using the operation unit 15. If the performance terminals 2 are connected to USB ports, the performance terminals 2 may be identified by USB port numbers.

The playing part assignment unit 50 sets the part assignment in the sequencing unit 51 by reading out the above table (part assignment information) from the HDD 13, and stores it in the sequencing unit 51.

The playing part assignment unit 50 determines whether or not the forward shift button B51 or the backward shift button B52 has been pressed (step S2). If it is determined that the forward shift button B51 or the backward shift button B52 has been pressed (YES in step S2), the playing part assignment unit 50 performs the above-described forward assignment change processing in the case of pressing of the forward shift button B51, or the backward assignment change processing in the case of pressing of the backward shift button B52. Thus, the playing part assignment unit 50 changes the playing part assignment settings in the sequencing unit 51 (step S3).

The forward and backward as used herein refer to the normal order and reverse order of the numbers indicated by the above-described terminal IDs. For example, suppose that the table shown in FIG. 14 is set in the sequencing unit 51. In the forward assignment change process, the content registered in the table in the sequencing unit 51 is modified so that the playing part with the part ID 1 is assigned to the Piano 2 and the playing part with the part ID 2 is assigned to the Piano 3. In the backward assignment change process, the content registered in the table in the sequencing unit 51 is modified so that the playing part with the part ID 1 is assigned to the Piano 5 and the playing part with the part ID 2 is assigned to the Piano 1. The playing part assignment unit 50 then returns the process to step S2.

If it is determined that the forward shift button B51 or the backward shift button B52 has not been pressed (NO in step S2), the playing part assignment unit 50 determines whether or not the random change button B53 has been pressed (step S4). If it is determined that the random change button B53 has been pressed (YES in step S4), the playing part assignment unit 50 performs the random assignment change process to modify the content registered in the table in the sequencing unit 51. Therefore, the playing part assignment settings are changed (step S5). The playing part assignment unit 50 then returns the process to step S2.

If it is determined that the random change button B53 has not been pressed (NO in step S4), the playing part assignment unit 50 determines whether or not a manual operation for individually changing the playing part assignment has been received in the manual assignment window W2 shown in FIG. 7 (step S6). If it is determined that a manual operation for individually changing the playing part assignment has been received (YES in step S6), the playing part assignment unit 50 modifies the content registered in the table in the sequencing unit 51 according to this operation, thereby changing the playing part assignment settings (step S7). The playing part assignment unit 50 then returns the process to step S2.

If it is determined that a manual operation for individually changing the playing part assignment has not been received (NO in step S6), the playing part assignment unit 50 determines whether or not the balanced change operation button B54 has been pressed (step S8). If it is determined that the balanced change operation button B54 has not been pressed (NO in step S8), the playing part assignment unit 50 returns the process to step S2. If it is determined that the balanced change operation button B54 has been pressed (YES in step S8), the playing part assignment unit 50 performs the balanced assignment change process and then returns the process to step S2.

Moreover, the playing part assignment unit 50 may perform the balanced assignment change process, when assigning obtained playing parts to the performance terminals 2 according to default settings and setting this assignment in the sequencing unit 51. FIG. 13 is a flowchart showing the procedure of another example of a playing part assignment process. In FIG. 13, processes corresponding to those in FIG. 12 are designated by identical process numerals, description of which is, therefore, omitted. In this embodiment, the playing part assignment unit 50 sets the part assignment in the sequencing unit 51 by reading out the above table (part assignment information) from the HDD 13, and then stores it in the sequencing unit 51 (step S101), followed by performing the processes following after the step S2. Thus, the balanced assignment change process may be performed (according to default settings) when selecting the music ensemble and reading out the music data.

Figure 15:
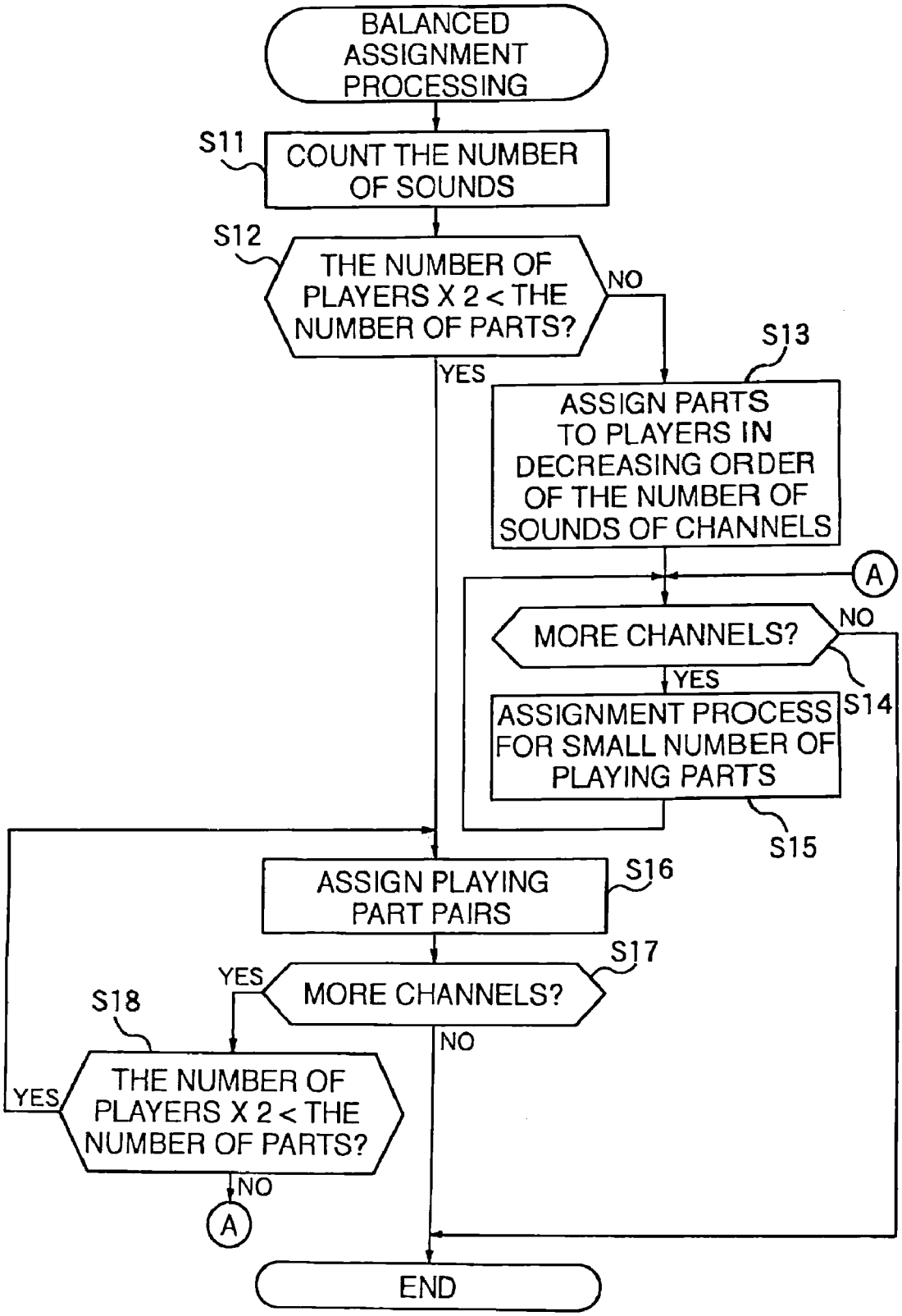
FIG. 15 is a flowchart showing the procedure of an example of balanced assignment change process.

FIG. 15 is a flowchart showing an example of the balanced assignment change process. First, the playing part assignment unit 50 counts the number of all Note On data (sound data) items (the number of sounds) of each playing part (step S11). Instead of by counting the number of Note On data items, the number of all Note On data items of each playing part may be obtained by including data indicating the number of all Note On data items of each playing part in the music data and by referring to this data.

Then, the playing part assignment unit 50 determines whether or not the number of performance terminals 2 (assignment target performance terminals) to which the playing parts are to be assigned×2<the number of playing parts (step S12). If it is not determined that the number of performance terminals 2 to which the playing parts are to be assigned×2<the number of playing parts (NO in step S12), the playing part assignment unit 50 assigns the playing parts to the assignment target performance terminals 2 one by one in decreasing order of the number of sounds (step S13).

The playing part assignment unit 50 determines whether or not unassigned playing parts exist (step S14). If it is determined that unassigned playing parts exist (YES in step S14), the playing part assignment unit 50 assigns a playing part with the largest number of sounds among the unassigned playing parts to a performance terminal 2 with the smallest total number of sounds of the assigned playing parts (the above-described assignment processing for a small number of playing parts) (step S15). This processing is repeated until no more unassigned playing parts exist. If it is determined that unassigned playing parts do not exist (NO in step S14), the process terminates.

If it is determined that the number of performance terminals 2 to which the playing parts are to be assigned×2<the number of playing parts (YES in step S12), the playing part assignment unit 50 assigns a pair of playing parts to each of the assignment target performance terminals 2 (step S16). Starting with the largest number of sounds and the smallest number of sounds, a pair of playing parts consisting of a playing part with the largest number of sounds−n and a playing part with the smallest number of sounds−n is sequentially assigned. That is, playing parts in decreasing order of the number of sounds are paired with playing parts in increasing order of the number of sounds respectively, and assigned to the performance terminals. The order of assignment may conform to the terminal IDs, for example.

The playing part assignment unit 50 determines whether or not unassigned playing parts exist (step S17). If it is determined that unassigned playing parts exist (YES in step S17), it is determined whether or not the number of performance terminals 2 to which the playing parts are to be assigned×2<the number of unassigned playing parts (step S18). If it is determined that the number of performance terminals 2 to which the playing parts are to be assigned×2<the number of unassigned playing parts (YES in step S18), the playing part assignment unit 50 returns the process to step S16. That is, the process of step S16 is performed for the unassigned playing parts.

If it is not determined that the number of performance terminals 2 to which the playing parts are to be assigned×2<the number of unassigned playing parts (NO in step S18), the playing part assignment unit 50 performs the process of step S15 described above.

If it is determined that unassigned playing parts do not exist (NO in step S17), the playing part processing unit 50 terminates the process.

The above-described playing part assignment processing ends when the PLAY button B2 is pressed or when termination of the application is instructed. The playing part assignment unit 50 returns the process to step S2.

As described above, in this embodiment, the assignment of the playing parts of the music data to the performance terminals 2 is set in the controller 1. The controller 1 controls playing of the performance terminals 2 so that they play music with the playing parts conforming to this assignment.

When a piece of music is played together for a number of times, the players may be bored with playing if the playing part assigned to each of the performance terminals 2 is not changed. Therefore, the facilitator or the like may change the assignment of the playing parts to the performance terminals 2. What is aimed at in this case is to change the playing part assigned to each of the performance terminals 2 to any other playing part. This allows the players to play music ensemble without being bored and enjoy playing together.

To meet the needs of the players and facilitator in this case with high operability, this embodiment allows the playing part assignment settings to be changed according to a predetermined pattern by a simple operation of only pressing any one of the forward shift button B51, the backward shift button B52, and the random change button B53.

As described above, in this embodiment, the playing part assignment unit 50 counts the number of sounds of each playing part. The playing part assignment is set in the sequencing unit 51 in such a manner that the playing parts are assigned to the performance terminals 2 so that the total number of sounds of playing parts assigned to each of the performance terminals 2 approximates the total number of sounds of playing parts assigned to the other performance terminals 2. When an operation signal of a playing operation is input to the communication unit 11, a playing pattern based on the playing part assignment settings is read out by the sequencing unit 51 as a playing pattern corresponding to a performance terminal 2 that has input the operation signal. Then, sound instruction data for this playing pattern is transmitted to the performance terminal 2. Therefore, the players of the performance terminals can play without the feeling of unfairness.

Although the present invention uses a plurality of performance terminals, a keyboard of a single performance terminal may be divided to implement functions of a plurality of performance terminals. That is, the keyboard may be divided by sound ranges, each corresponding to a playing part, so that music may be played on the single performance terminal like four-handed playing. Also, any one of the performance terminals may have the functions of the controller so that this performance terminal may serve as the controller.

It is to be understood that the object of the present invention may also be accomplished by supplying a computer, for example, the controller 1 with a storage medium in which a program code of software which realizes the functions of the above described embodiment is stored, and causing a computer (or CPU or MPU) of the system or apparatus to read out and execute the program code stored in the storage medium.

In this case the program code itself read from the storage medium realizes the functions of any of the embodiments described above, and hence the program code and the storage medium in which the program code is stored constitute the present invention.

Examples of the storage medium for supplying the program code include a floppy™ disk, a hard disk, a magnetic-optical disk, a CD-ROM, a CD-R, a CD-RW, DVD-ROM, a DVD-RAM, a DVD-RW, a DVD+RW, a magnetic tape, a nonvolatile memory card, and a ROM. Alternatively, the program may be downloaded via a network.

Further, it is to be understood that the functions of the above described embodiment may be accomplished not only by executing a program code read out by a computer, but also by causing an OS (operating system) or the like which operates on the computer to perform a part or all of the actual operations based on instructions of the program code.

Further, it is to be understood that the functions of the above described embodiment may be accomplished by writing a program code read out from the storage medium into a memory provided on an expansion board inserted into a computer or in an expansion unit connected to the computer and then causing a CPU or the like provided in the expansion board or the expansion unit to perform a part or all of the actual operations based on instructions of the program code.

What is claimed is:

1. A music ensemble system comprising a plurality of performance terminals and a controller capable of communicating with said performance terminals to control playing of said performance terminals, each of said performance terminals comprising:

a playing operation unit adapted to receive a player's playing operation and generate operation information;

a terminal communication unit adapted to communicate with said controller to transmit the operation information to said controller; and a tone generator adapted to produce musical sounds based on sound instruction data received by said terminal communication unit, and said controller comprising:

a controller communication unit adapted to communicate with each of said performance terminals;

a music data storage unit adapted to contain music data including a plurality of playing parts;

a playing control unit adapted to, upon reception of the operation information by said controller communication unit from said performance terminal, read out a playing part assigned to said performance terminal from said music data storage unit based on part assignment information indicating the assignment of the playing parts to said performance terminals, and transmit sound instruction data for sounding the playing part to said performance terminal via said controller communication unit;

an operation unit having a part change operator; and a playing part changing unit adapted to modify the part assignment information according to a predetermined change pattern upon operation of the part change operator.

2. A controller capable of communicating with a plurality of performance terminals to control performance of said performance terminals, each of said performance terminals having a function of receiving a player's playing operation, generating operation information, and transmitting the operation information to said controller, and a function of producing musical sounds based on sound instruction data, said controller comprising:

a communication unit adapted to communicate with each of said performance terminals;

a music data storage unit adapted to contain music data including a plurality of playing parts;

a playing control unit adapted to, upon reception of the operation information by said communication unit from said performance terminal, read out a playing part assigned to said performance terminal from said music data storage unit based on part assignment information indicating the assignment of the playing parts to said performance terminals, and transmit sound instruction data for sounding the playing part to said performance terminal via said communication unit;

an operation unit having a part change operator; and a playing part changing unit adapted to modify the part assignment information according to a predetermined change pattern upon operation of the part change operator.

3. A controller according to claim 2, wherein said playing control unit stores, as the part assignment information, information associating IDs indicating the order of said performance terminals with corresponding playing parts, and said playing part changing unit modifies the part assignment information by shifting the correspondence between the playing parts and the IDs by a predetermined number in the order indicated by the IDs or in the reverse order thereof.

4. A controller according to claim 2, wherein said playing control unit stores, as the part assignment information, information associating IDs of said performance terminals with corresponding playing parts, and said playing part changing unit modifies the part assignment information by randomly changing the correspondence between the playing parts and the IDs.

5. A program for causing a controller of controlling playing of a plurality of performance terminals to execute:

a receiving process of receiving operation information generating, upon reception of a player's playing operation, by said performance terminal;

a playing control process of, upon reception of the operation information in said receiving process, reading out a playing part assigned to said performance terminal based on part assignment information indicating the assignment of the playing parts to said performance terminals, among music data including playing parts, each of the playing parts including a plurality of sound data items, transmitting sound data items of the playing part to said performance terminal via said controller communication unit, and causing said performance terminal to produce musical sounds based on sound data; and a playing part change process of, upon reception of a changing operation of changing the playing part, modifying the part assignment information according to a predetermined change pattern.

6. A music ensemble system comprising a plurality of performance terminals and a controller capable of communicating with said performance terminals to control playing of said performance terminals, each of said performance terminals comprising:

a playing operation unit adapted to receive a player's playing operation and generate operation information;

a terminal communication unit adapted to communicate with said controller to transmit the operation information to said controller; and a tone generator adapted to produce musical sounds based on sound data items received by said terminal communication unit, and said controller comprising:

a controller communication unit adapted to communicate with each of said performance terminals;

a music data storage unit adapted to contain music data including a plurality of playing parts, each of the playing parts including a plurality of sound data items;

a playing control unit adapted to, upon reception of the operation information by said controller communication unit from said performance terminal, read out a playing part assigned to said performance terminal from said music data storage unit based on part assignment information indicating the assignment of the playing parts to said performance terminals, and transmit sound data items of the playing part to said performance terminal via said controller communication unit;

an operation unit including a playing part changing operator adapted to receive a changing operation of changing the playing part; and a playing part assignment unit adapted to, upon reception of the changing operation by said operation unit, compute the number of sound data items of each playing part and set the playing part assignment information in said playing control unit based on the computed number so that sound data items assigned to said performance terminals approximate one another in number.

7. A music ensemble system comprising a plurality of performance terminals and a controller capable of communicating with said performance terminals to control playing of said performance terminals, each of said performance terminals comprising:

a playing operation unit adapted to receive a player's playing operation and generate operation information;

a terminal communication unit adapted to communicate with said controller to transmit the operation information to said controller; and a tone generator adapted to produce musical sounds based on sound data items received by said terminal communication unit, and said controller comprising:

a controller communication unit adapted to communicate with each of said performance terminals;

a music data storage unit adapted to contain music data including a plurality of playing parts, each of the playing parts including a plurality of sound data items;

a playing control unit adapted to, upon reception of the operation information by said controller communication unit from said performance terminal, read out a playing part assigned to said performance terminal from said music data storage unit based on part assignment information indicating the assignment of the playing parts to said performance terminals, and transmit sound data items of the playing part to said performance terminal via said controller communication unit;

an operation unit including a readout operator adapted to receive a readout operation of reading out the music data; and a playing part assignment unit adapted to, upon reception of the readout operation by said operation unit, compute the number of sound data items of each playing part and set the playing part assignment information in said playing control unit based on the computed number so that sound data items assigned to said performance terminals approximate one another in number.

8. A controller connected with a plurality of performance terminals to control playing of said performance terminals, each of said performance terminals having a function of receiving a player's playing operation, generate operation information, and a function of producing musical sounds based on sound data, said controller comprising:

a controller communication unit adapted to communicate with each of said performance terminals;

a music data storage unit adapted to contain music data including a plurality of playing parts, each of the playing parts including a plurality of sound data items;

a playing control unit adapted to receive the operation information generated by said performance terminal via said controller communication unit, read out a playing part assigned to said performance terminal from said music data storage unit based on part assignment information indicating the assignment of the playing parts to said performance terminals, and transmit sound data items of the playing part to said performance terminal via said controller communication unit;

an operation unit including a playing part changing operator adapted to receive a changing operation of changing the playing part; and a playing part assignment unit adapted to, upon reception of the changing operation by said operation unit, compute the number of sound data items of each playing part and set the playing part assignment information in said playing control unit based on the computed number so that the number of sound data items assigned to each of the performance terminals approximates the number of sound data items assigned to the other performance terminals.

9. A controller according to claim 8, wherein when the number of the playing parts is not less than twice the number of said performance terminals to which the playing parts are to be assigned, said playing part assignment unit sets the playing part assignment information in said playing control unit so that playing parts in decreasing order of the number of sounds are paired with playing parts in increasing order of the number of sounds respectively and assigned to each of said performance terminals.

10. A controller connected with a plurality of performance terminals to control playing of said performance terminals, each of said performance terminals having a function of receiving a player's playing operation to generate operation information, and a function of producing musical sounds based on sound data, said controller comprising:

a controller communication unit adapted to communicate with each of said performance terminals;

a music data storage unit adapted to contain music data including a plurality of playing parts, each of the playing parts including a plurality of sound data items;

a playing control unit adapted to receive the operation information generated by said performance terminal via said controller communication unit, read out a playing part assigned to said performance terminal from said music data storage unit based on part assignment information indicating the assignment of the playing parts to said performance terminals, and transmit sound data items of the playing part to said performance terminal via said controller communication unit;

an operation unit including a readout operator adapted to receive a readout operation of reading out the music data; and a playing part assignment unit adapted to, upon reception of the readout operation by said operation unit, compute the number of sound data items of each playing part and set the playing part assignment information in said playing control unit based on the computed number so that sound data items assigned to said performance terminals approximate one another in number.

11. A controller according to claim 10, wherein when the number of the playing parts is more than twice the number of said performance terminals to which the playing parts are to be assigned, said playing part assignment unit sets the playing part assignment information in said playing control unit so that playing parts in decreasing order of the number of sounds are paired with playing parts in increasing order of the number of sounds respectively and assigned to each of said performance terminals.

12. A program for causing a controller of controlling playing of a plurality of performance terminals to execute:

a receiving process of receiving operation information generating, upon reception of a player's playing operation, by said performance terminal;

a playing control process of, upon reception of the operation information in said receiving process, reading out a playing part assigned to said performance terminal based on part assignment information indicating the assignment of the playing parts to said performance terminals, among music data including playing parts, each of the playing parts including a plurality of sound data items, transmitting sound data items of the playing part to said performance terminal via said controller communication unit, and causing said performance terminal to produce musical sounds based on sound data; and a playing part assignment of, upon reception of a changing operation of changing the playing part, computing the number of sound data items of each of the playing parts and setting the playing part assignment information in said playing control unit based on the computed number so that sound data items assigned to the performance terminals approximate one another in number.

13. A program for causing a controller of controlling playing of a plurality of performance terminals to execute:

a receiving process of receiving operation information generating, upon reception of a player's playing operation, by said performance terminal;

a playing control process of, upon reception of the operation information in said receiving process, reading out a playing part assigned to said performance terminal based on part assignment information indicating the assignment of the playing parts to said performance terminals, among music data including playing parts, each of the playing parts including a plurality of sound data items, transmitting sound data items of the playing part to said performance terminal via said controller communication unit, and causing said performance terminal to produce musical sounds based on sound data; and a playing part assignment of, upon reception of a read out operation of reading out the music data, computing the number of sound data items of each of the playing parts and setting the playing part assignment information in said playing control unit based on the computed number so that sound data items assigned to the performance terminals approximate one another in number.

* * * * *